US008826487B2

(12) United States Patent
Lee

(10) Patent No.: US 8,826,487 B2
(45) Date of Patent: Sep. 9, 2014

(54) MOP CLEANING SET

(71) Applicant: Pei-Yuan Lee, Changhua (TW)

(72) Inventor: Pei-Yuan Lee, Changhua (TW)

(73) Assignee: Rock Tone Enterprise Co. Ltd., Changhua (TW)

( * ) Notice: Subject to any disclaimer, the term of this patent is extended or adjusted under 35 U.S.C. 154(b) by 0 days.

(21) Appl. No.: 14/256,970

(22) Filed: Apr. 20, 2014

(65) Prior Publication Data

US 2014/0223686 A1 Aug. 14, 2014

Related U.S. Application Data

(62) Division of application No. 13/338,100, filed on Dec. 27, 2011.

(51) Int. Cl.
*A47L 13/58* (2006.01)

(52) U.S. Cl.
CPC ..... *A47L 13/58* (2013.01)
USPC ..... 15/260; 34/58

(58) Field of Classification Search
USPC ..... 15/260, 263; 34/58
See application file for complete search history.

(56) References Cited

U.S. PATENT DOCUMENTS

| | | | | |
|---|---|---|---|---|
| 7,743,528 | B2 * | 6/2010 | Lin | 34/58 |
| 8,028,369 | B2 * | 10/2011 | Chiang | 15/260 |
| 8,336,160 | B2 * | 12/2012 | Chen | 15/260 |
| 8,347,451 | B2 * | 1/2013 | Chen | 15/260 |
| 8,544,133 | B2 * | 10/2013 | Fischer et al. | 15/98 |

* cited by examiner

*Primary Examiner* — Randall Chin
(74) *Attorney, Agent, or Firm* — Che-Yang Chen; Law Office of Michael Chen

(57) ABSTRACT

A mop cleaning set includes a mop structure and a dehydration device, the dehydration device is used for dehydrating the mop structure, the dehydration device comprises a mop supporting unit, and the dehydration device is used for fixing the mop structure so that the mop structure will not be thrown out during a dehydration process by spinning when the centrifugal force is too strong, therefore the invention is convenient to use.

20 Claims, 32 Drawing Sheets

PRIOR ART

MOP CLEANING SET

CROSS-REFERENCE TO RELATED APPLICATIONS

This application is a divisional application of application Ser. No. 13/338,100, filed on Dec. 27, 2011, now pending, the entire contents of which are incorporated by reference.

BACKGROUND

1. Field of Invention

The invention relates to a mop cleaning set and more particularly to a mop structure and a dehydration device for dehydrating the mop structure.

2. Related Art

A common mop cleaning set for mopping floors mostly comprises a mop structure and a dehydration device for dehydrating the mop structure. Referring to FIG. 1, which is a structural illustration of a conventional dehydration device. As shown in FIG. 1, a conventional dehydration device structure 1 mainly comprises a dehydration basket 10, a connecting bar 11 and a base 12, the dehydration basket 10 is connected to an end of the connecting bar 11 and it is used for placing a mop (not illustrated in the drawing) to be dehydrated, and another end of the connecting bar 11 is disposed in a through hole 121 of the base 12. Furthermore, in order to prevent the connecting bar 11 sinking into the base 12 because of a pressure applied on the dehydration basket 10 by the mop during a dehydration process, the conventional dehydration device structure 1 employs a retaining ring 13 (e.g. a C shaped ring) to fasten the connecting bar 11 so that it is fixed in the through hole 121 of the base 12 more securely.

However, in the abovementioned structure, because the connecting bar 11 is fixed in the through hole 121 of the base 12 only by the retaining ring 13, the retaining ring 13 can be easily deformed or even fall off due to constant and momentary high pressures sustained in repeated dehydration actions by the user. As a result, the entire structure cannot be used due to the damaged retaining ring 13, and the life expectancy of usage is reduced substantially. Therefore, aspects of the invention aim to improve the abovementioned drawbacks.

A mop structure has always been a cleaning tool for cleaning floors, and a conventional mop structure usually has a long handle and a fixing base connected with a cleaning cloth or sponge. The cleaning cloth or sponge of a conventional mop has to be squeezed by the user by hands or in a squeezing device on the base to dehydrate the water after it is cleaned by water. It is rather troublesome and inconvenient for the user to dehydrate water this way and the effect of dehydration is not ideal.

SUMMARY

Embodiments of the invention provide a mop cleaning set which includes a mop structure and a dehydration device for dehydrating the mop structure. The dehydration device includes a base having a through hole; a mop supporting unit disposed above the base and a bar fixing portion is disposed on its bottom for supporting a mop; and a bar penetrated and fixed in the bar fixing portion of the bottom of the mop supporting unit and the through hole of the base respectively, a first protruded portion and a second protruded portion are disposed on the bar, the first protruded portion is disposed between a bottom surface of the mop supporting unit and a top surface of the base for supporting the mop supporting unit, the second protruded portion is disposed below the through hole of the base for fixing the bar in the through hole of the base.

In one embodiment, the dehydration device is provided for use with the mop structure of the invention, the mop structure is placed in the mop supporting unit and is fixed by the dehydration device, so that the mop structure will not be thrown out during a dehydration process by spinning when the centrifugal force is too strong.

BRIEF DESCRIPTION OF THE DRAWINGS

Corresponding reference characters indicate corresponding parts throughout the drawings.

DETAILED DESCRIPTION

Figure 1:
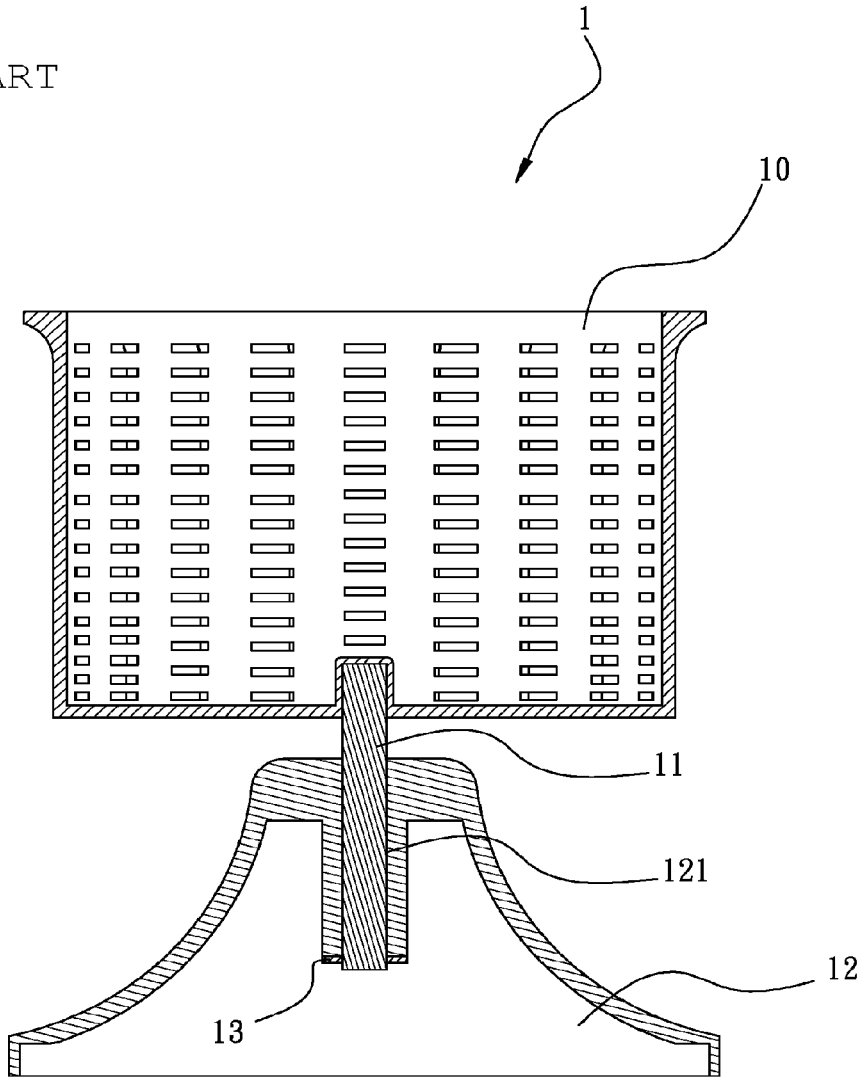
FIG. 1 is a structural illustration of a conventional dehydration device in the prior art.
Figure 2A:
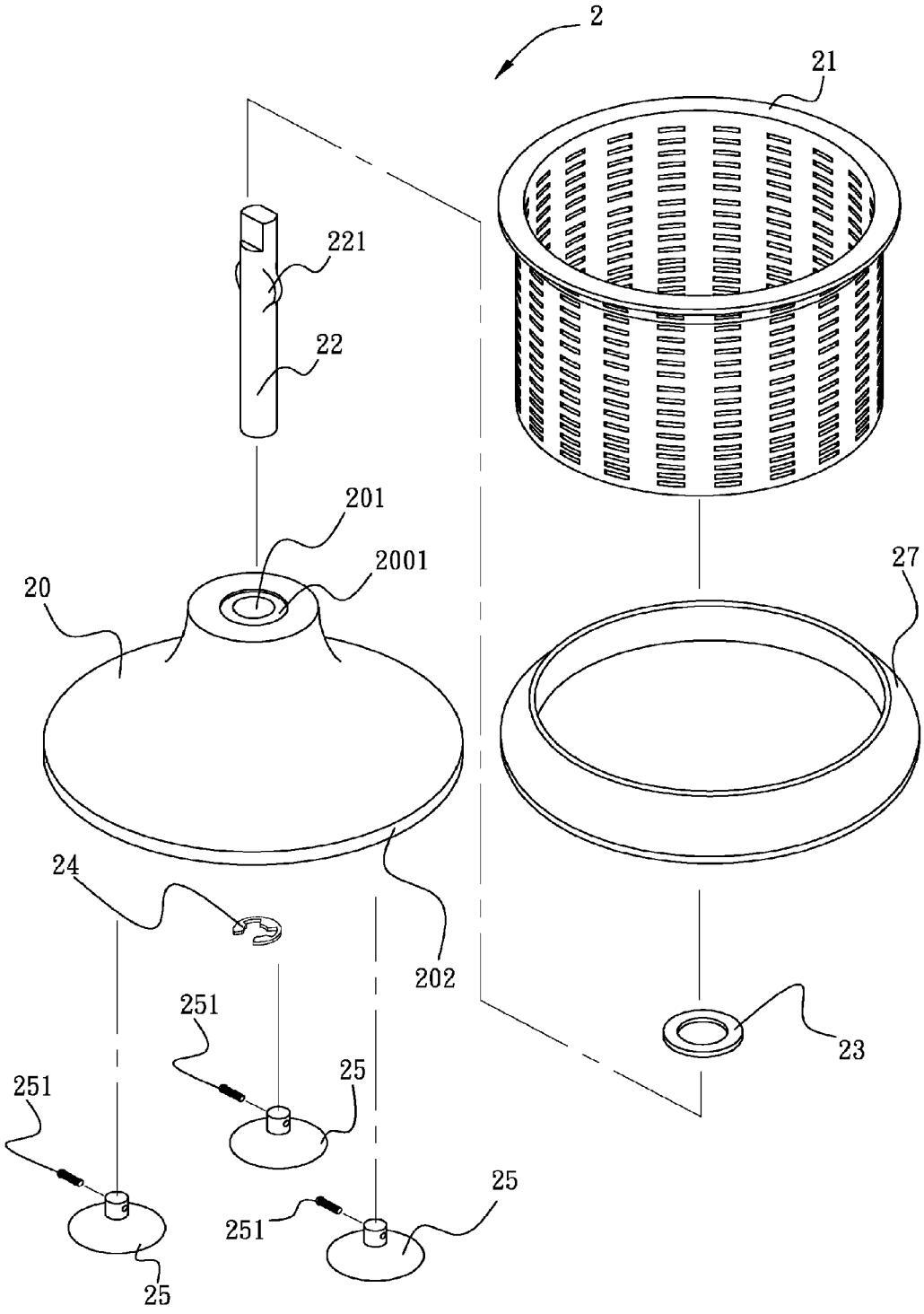
FIGS. 2*a*, 2*b* and 2*c* are illustrations of a dehydration device of an embodiment of the invention.
Figure 2B:
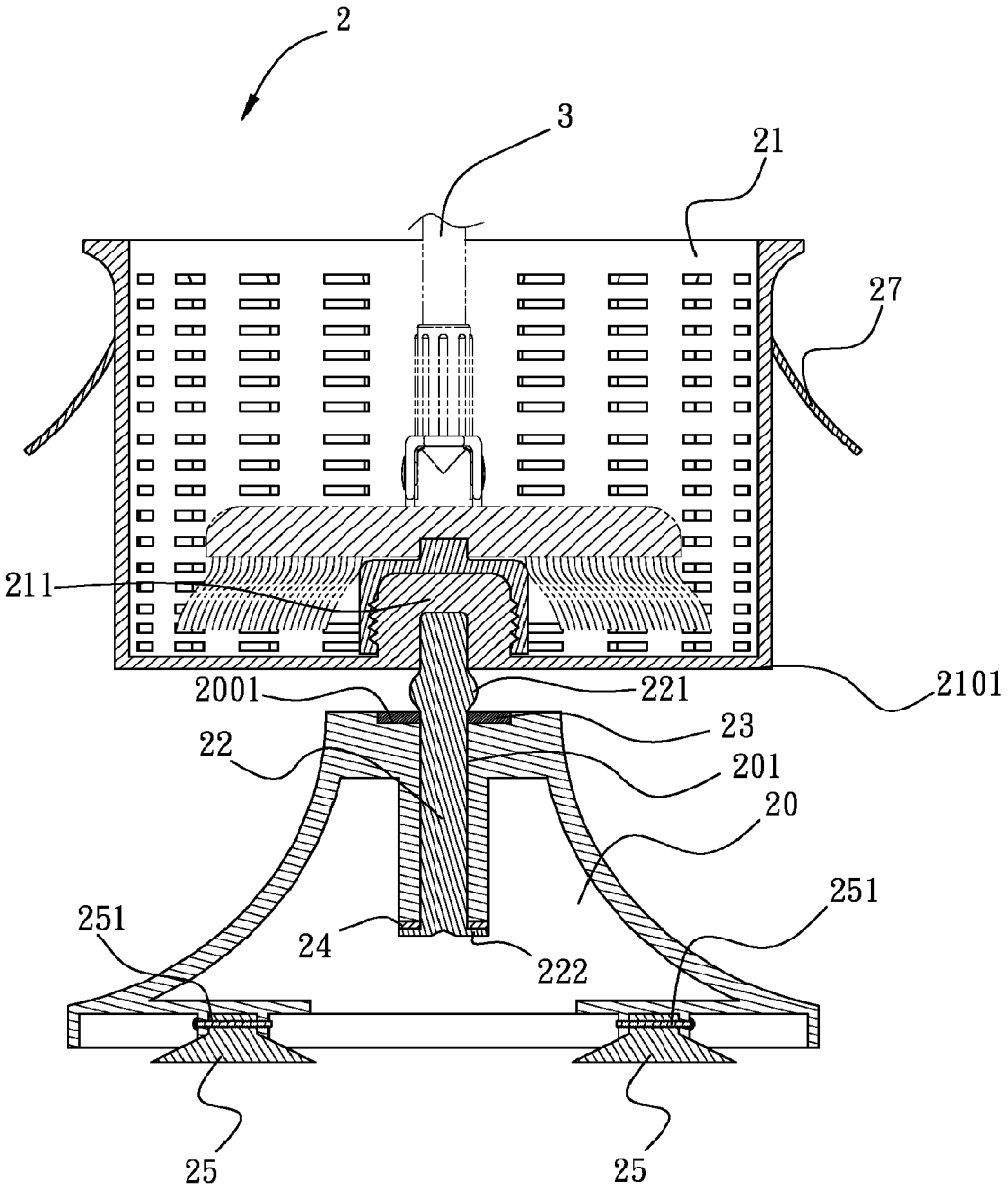
Figure 2C:
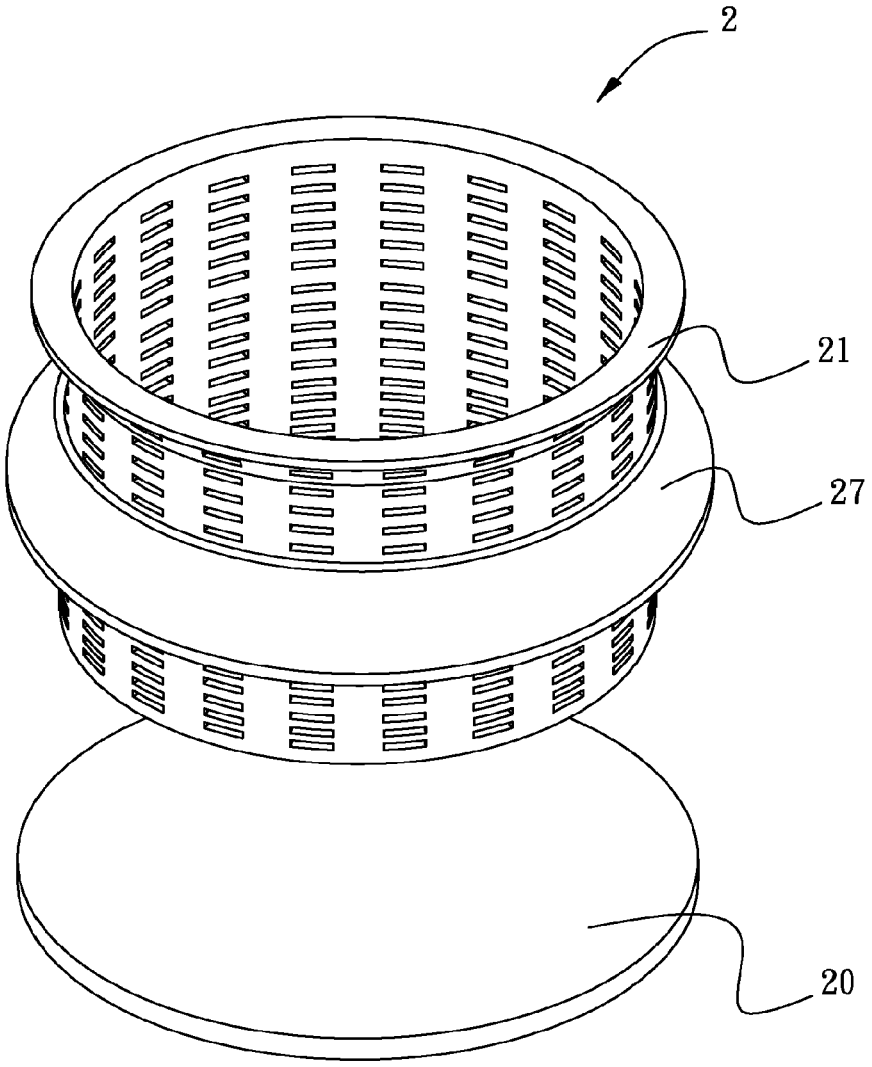

The invention will become more fully understood by reference to the following detailed description thereof when read in conjunction with the included drawings. One embodiment of the invention provides a mop cleaning set which comprises a mop structure and a dehydration device for dehydrating the mop structure. Referring to FIGS. 2*a*, 2*b* and 2*c*, a dehydration device 2 of the invention includes a base 20, a mop supporting unit 21 and a bar 22, the base 20 has a through hole 201. The mop supporting unit 21 is a dehydration basket with a plurality of holes and it is disposed above the base 20, a bar fixing portion 211 is disposed on a bottom of the mop supporting unit 21, the mop supporting unit 21 is used for placing a mop structure 3; the bar 22 is penetrated and fixed in the bar fixing portion 211 of the bottom of the mop supporting unit 21 and the through hole 201 of the base 20 respectively, a main technical means of the dehydration device 2 of the invention is embodied in the bar 22 which has a first protruded portion 221 and a second protruded portion 222, the first protruded portion 221 is an arc shaped structure and it is disposed between a bottom surface 2101 of the mop supporting unit 21 and a top surface 2001 of the base 20 for supporting the mop supporting unit 21, and the second protruded portion 222 is disposed below the through hole 201 of the base 20 for fixing the bar 22 in the through hole 201 of the base 20. In one embodiment, the mop structure 3 may include a circular cleaning cloth.

As shown in FIGS. 2*a* and 2*b*, the dehydration device 2 of the invention further includes a first metal ring 23 and a second metal ring 24, the first metal ring 23 is sleeved on the bar 22 and is disposed between the first protruded portion 221 and the top surface 2001 of the base 20, the first metal ring 23 is used for the first protruded portion 221 to press against to prevent the first protruded portion 221 from pressing on the top surface 2001 of the base 20 directly; the second metal ring 24 is sleeved on the bar 22 and it is disposed between the second protruded portion 222 and a bottom of the through hole 201, the second metal ring 24 is used for the second protruded portion 222 to press against to prevent the second protruded portion 222 from pressing on the bottom of the through hole 201 of the base 20 directly.

A plurality of suction discs 25 is disposed on a bottom 202 of the base 20 of the dehydration device 2 of the invention, each of the suction discs 25 is connected to the bottom 202 of the base 20 by a fixing pole 251. By the disposition of the suction discs 25, the base 20 can be sucked and fixed on any flat surfaces such as on a floor or in a water dehydration bucket, and after the base 20 is fixed, the mop supporting unit 21 can be driven or exerted by an external force to process dehydration by spinning (not illustrated in the drawings as it is conventional). FIG. 2*c* shows an external structure of the invention after all the abovementioned elements are assembled together.

Figure 3:
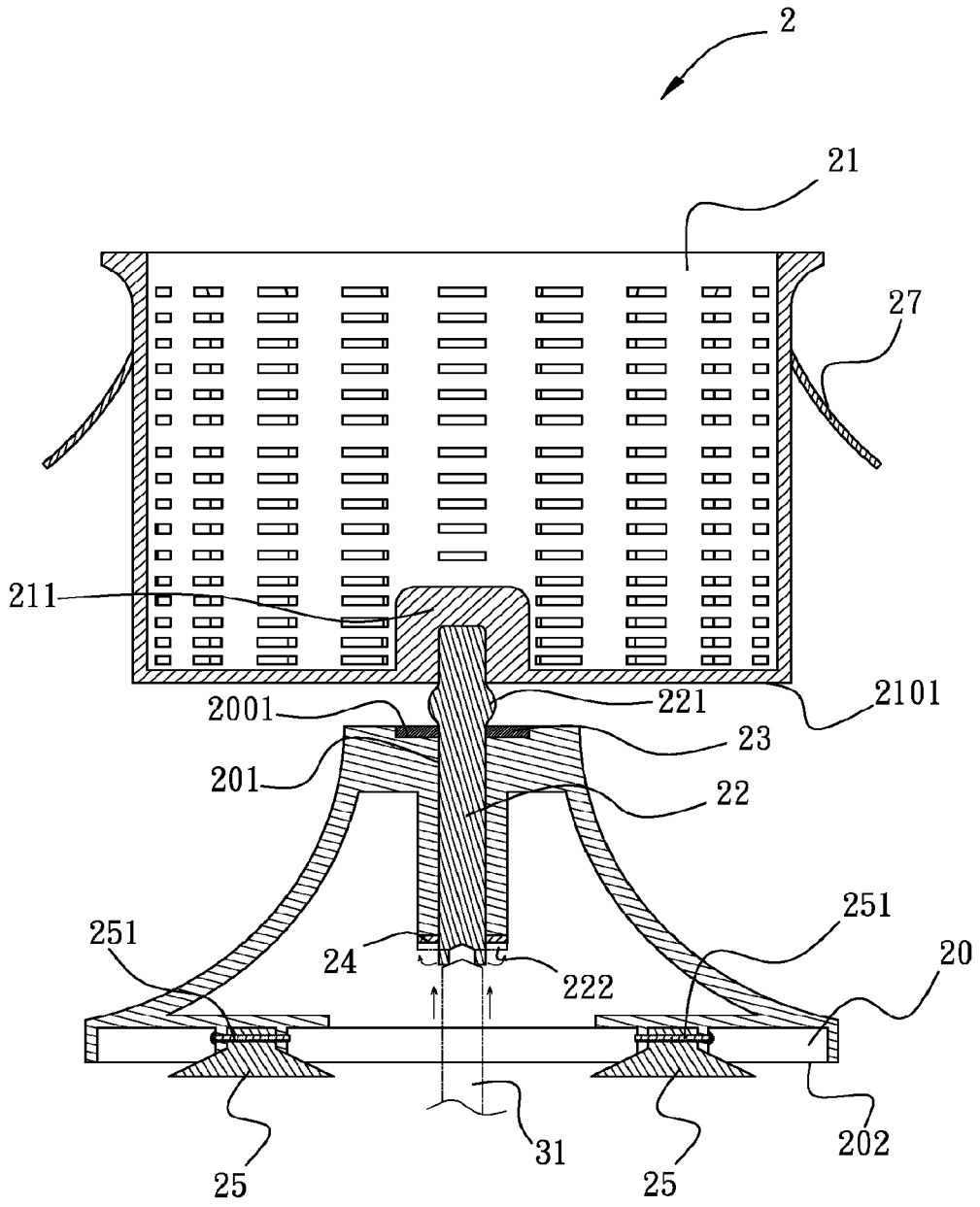
FIG. 3 is an illustration of a forming method of a second protruded portion of the dehydration device of an embodiment of the invention.

Referring to FIG. 3, which is an illustration of a forming method of the second protruded portion 222 of the dehydration device 2 of the invention. As clearly shown in the drawing, the second protruded portion 222 is formed by pressing upwardly from below by a pressing body 31, then the second protruded portion 222 is bent upward and fixed on the second metal ring 24. The bar 22 can be fixed in the through hole 201 of the base 20 more securely by the second protruded portion 222 which is formed by pressing, and with the disposition of the first protruded portion 221, the overall stability of the structure of the dehydration device 2 and the life expectancy can be enhanced.

Figure 4A:
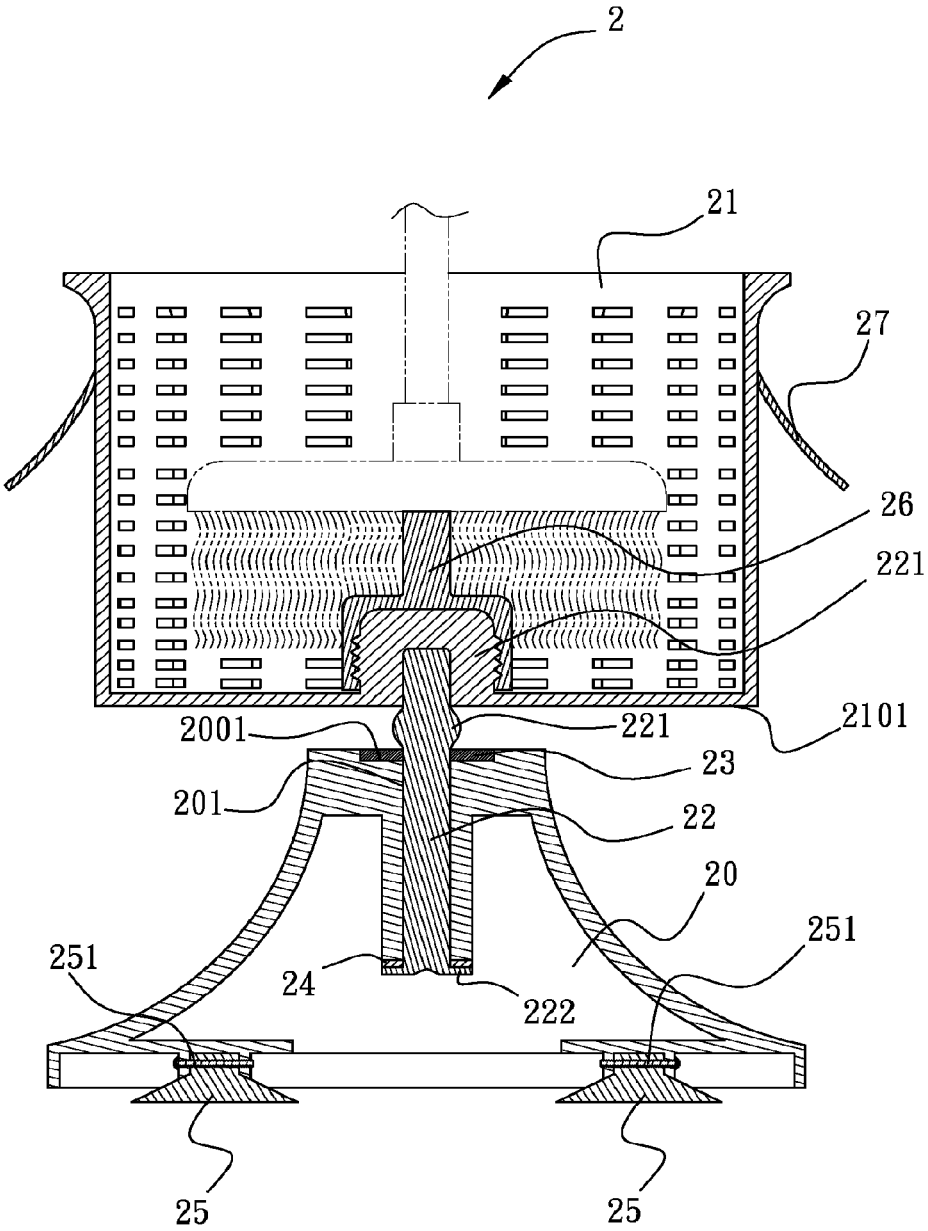
FIGS. 4*a* and 4*b* are illustrations of a mop fixing element and a water blocking plate of the dehydration device of an embodiment of the invention.
Figure 4B:
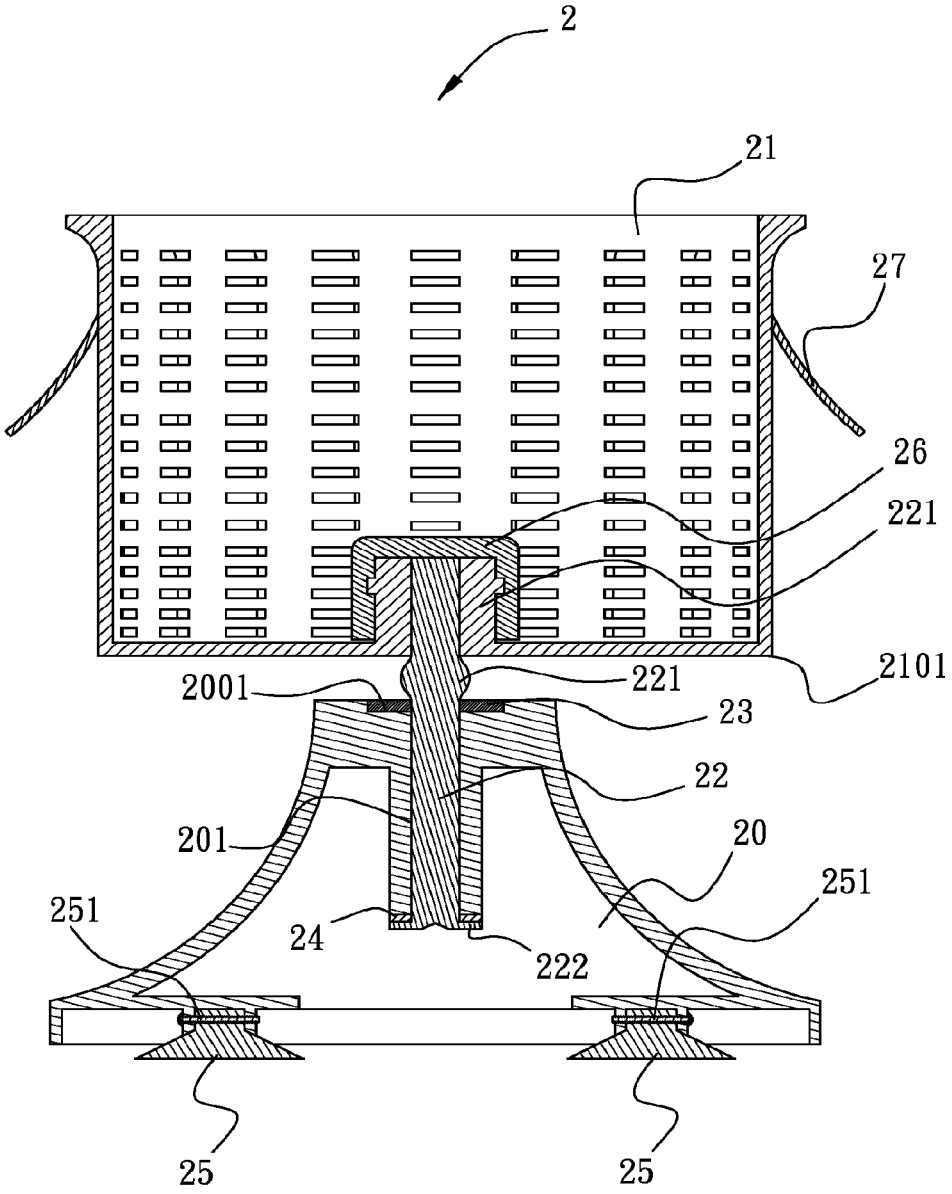

Referring to FIGS. 4*a* and 4*b*, the dehydration device 2 of the invention further comprises a mop fixing element 26 and a water blocking plate 27. As shown in the drawing, the mop fixing element 26 is disposed in the mop supporting unit 21 and is locked or fitted on the bar fixing portion 211, it is used for fixing the mop structure 3 so that the mop structure 3 will not be thrown out during a dehydration process by spinning when the centrifugal force is too strong. The mop fixing element 26 can in a circular pillar shape as shown in FIG. 4*a* or a circular cap shape as shown in FIG. 4*b*. The water blocking plate 27 is fitted on the mop supporting unit 21 externally and can be moved upward and downward on the mop supporting unit 21, and an included angle between the water blocking plate 27 and an outside surface of the mop supporting unit 21 is less than 90 degrees. When the mop structure 3 is placed in the mop supporting unit 21 for dehydration, the water thrown out can be blocked by the water blocking plate 27.

As a conclusion from the abovementioned technical description, it is clearly shown that a main technical means employed in the dehydration device 2 of the invention is the disposition of the first protruded portion 221 and the second protruded portion 222 on the bar 22 connected between the mop supporting unit 21 and the base 20, and the overall structure can be more stable and secured with the disposition of the first protruded portion 221 and the second protruded portion 222, and the abrasion and wear between each of the elements can be reduced substantially. Therefore, the drawbacks of conventional techniques can be solved by the improved structure of the dehydration device 2 of the embodiments of the invention.

Figure 5:
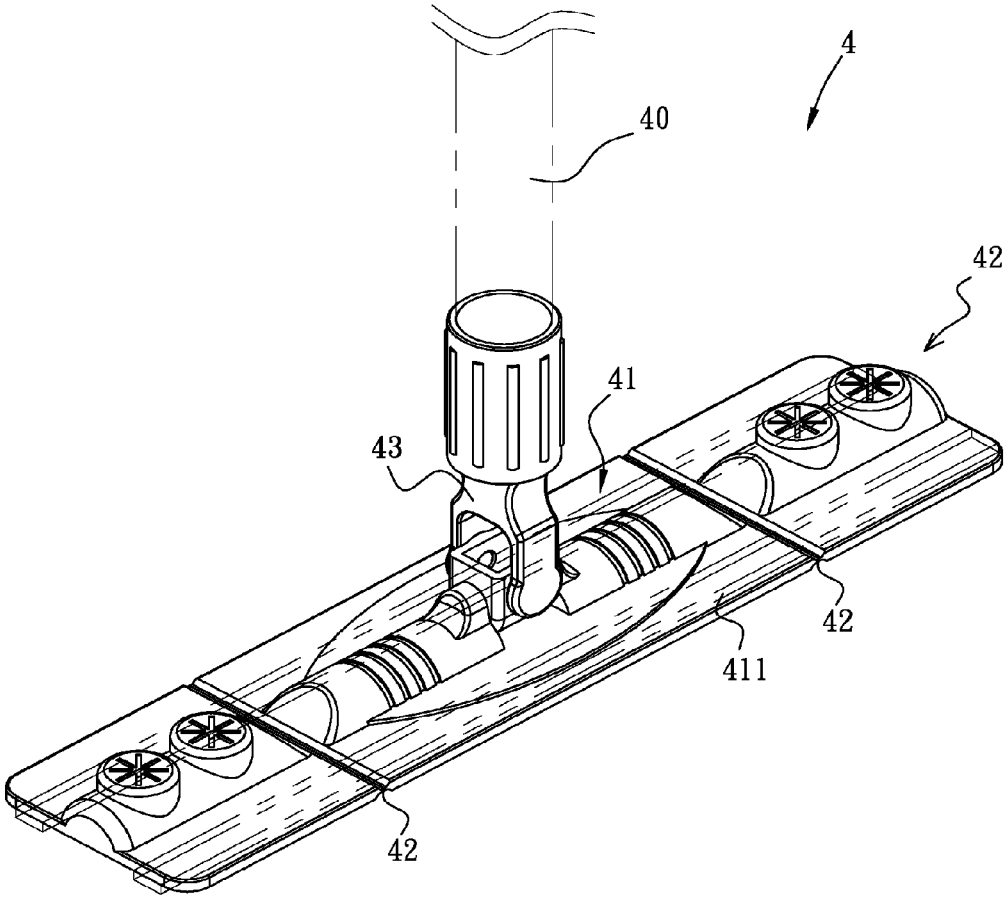
FIG. 5 is an illustration of a mop structure of a first embodiment of the invention.

FIG. 5 illustrates a first embodiment of the mop structure of the invention. As shown, a mop structure 4 comprises a grip bar 40, a fixing base 41 and a connecting portion 42. The fixing base 41 has a first fixing base portion 411 and a second fixing base portion 412. The fixing base 41 is used for supporting and fixing a cleaning body (not illustrated in the drawing), and the first fixing base portion 411 is pivotally connected to the grip bar 40 via a pivotal unit 43; by the disposition of the pivotal unit 43, the fixing base 41 can rotate in different angles using the grip bar 41 as the axis; the fixing base 41 can thus be rotated in suitable angles to fit different cleaning angles when the mop structure 4 is used by the user for cleaning. A main technical means of the mop structure 4 of the invention is the connecting portion 42 connected with the first fixing base portion 411 and the second fixing base portion 412, the connecting portion 42 is made of a flexible material and the second fixing base portion 412 can be pushed or exerted by an external force to be folded in a first direction or a second direction because of the flexibility of the connecting portion 42. Because the connecting portion 42, the first fixing base portion 411 and the second fixing base portion 412 are formed in one piece during manufacturing, in comparing with the conventional mop structures (a main plate is connected with two wing plates at two ends through different elements), besides that the costs can be reduced effectively by the mop structure 4 of the invention, a probability of damage can be reduced substantially due to its simple structures. Structures of the elements of the mop structure 4 of the invention will be described in details hereinafter.

Figure 6A:
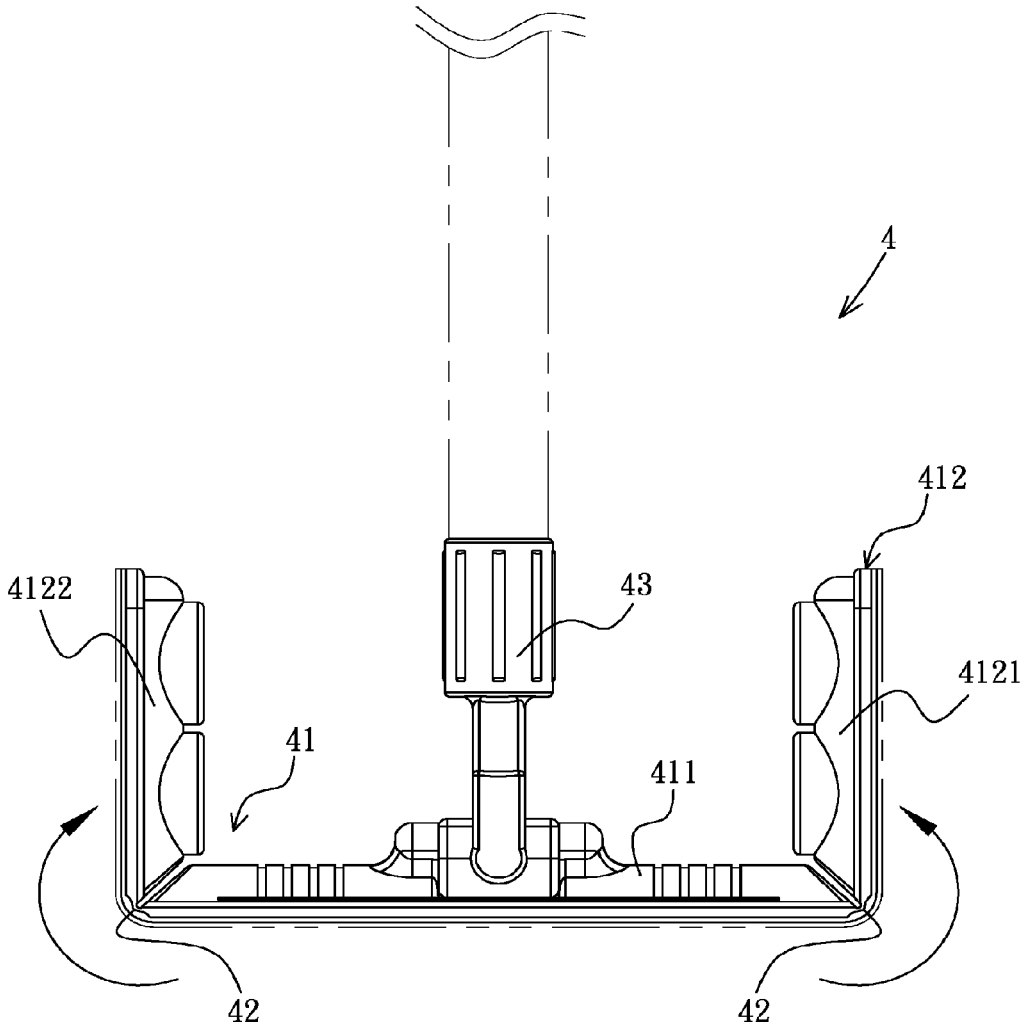
FIGS. 6*a*, 6*b* and 6*c* are illustrations of the mop structure of an embodiment of the invention in operation.
Figure 6B:
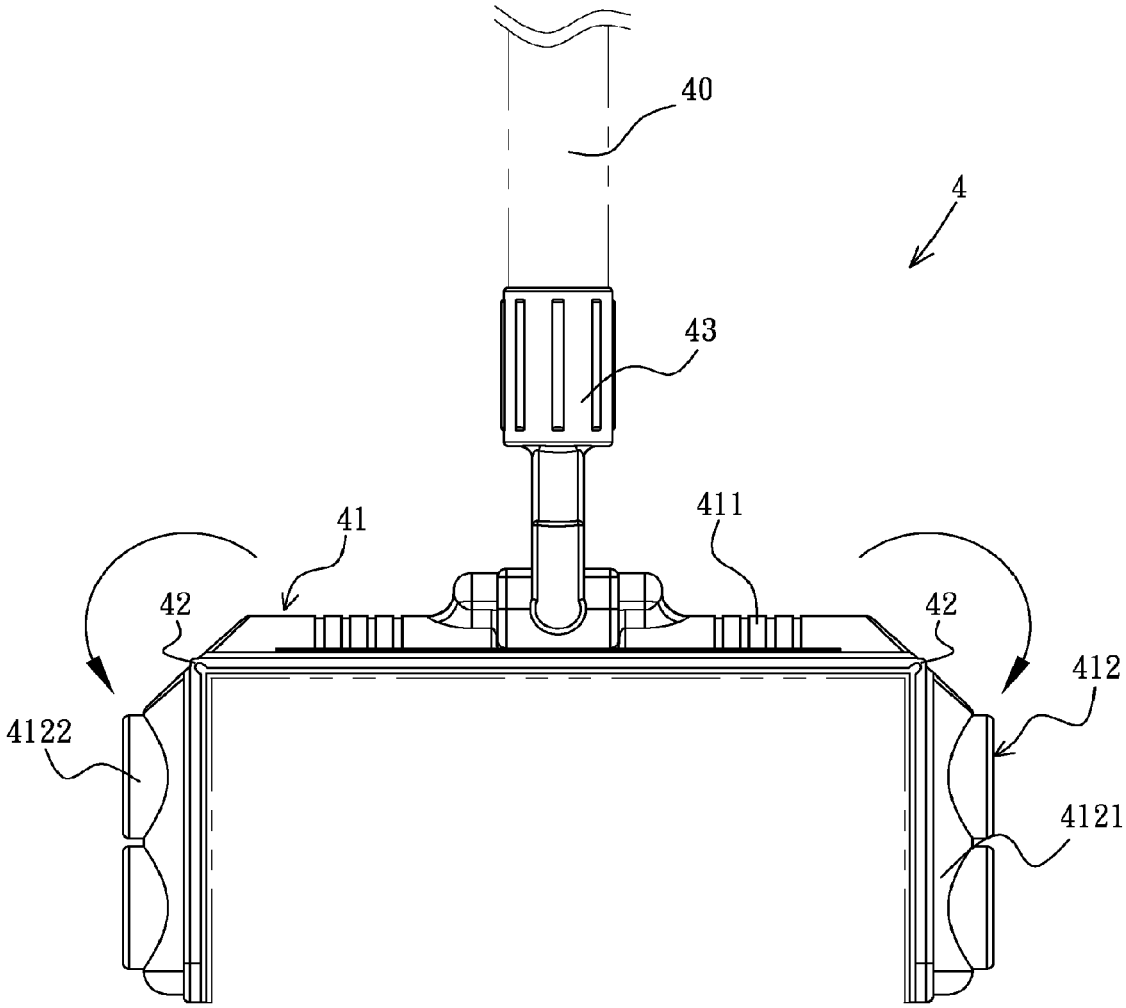
Figure 6C:
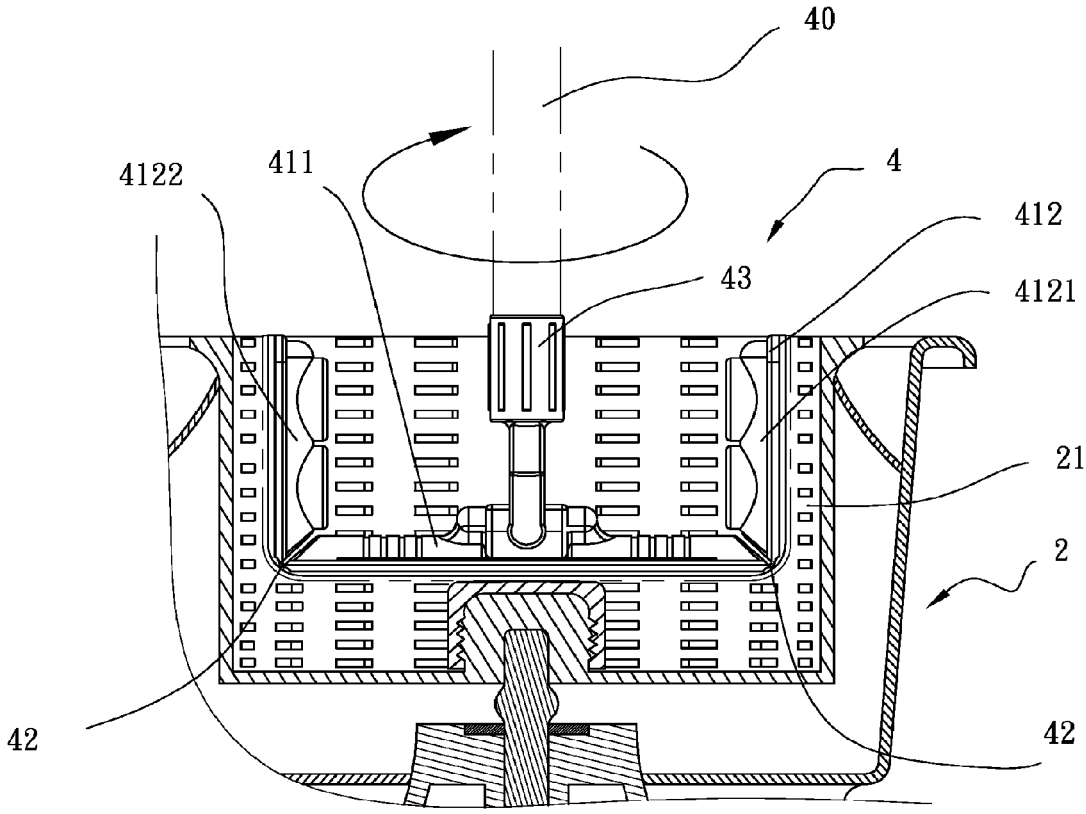

Referring to FIGS. 6*a*, 6*b* and 6*c*, which are illustrations of the mop structure 4 of the invention being used. As shown in FIG. 6*a*, the second fixing base portion 412 comprises a first plate 4121 and a second plate 4122, and they are connected with two ends of the first fixing base portion 411 respectively via the connecting portion 42; when the mop structure 4 is required to be placed in a water bucket with a dehydrated device (not illustrated in the drawing) by the user for dehydration, the first plate 4121 and the second plate 4122 will be folded upward (as illustrated by two arrows in the drawing) simply by exerting a force on the fixing base 41 by the user. A U-shaped structure is formed by the first plate 4121, the second plate 4122 and the first fixing base portion 411 after they are folded upward, thereby a size of the fixing base 41 becomes smaller, a size of the water bucket can also be smaller and dehydration can be finished faster. As shown in FIG. 6*b*, besides that the first plate 4121 and the second plate 4122 can be folded upward, they can also be folded downward (as illustrated by two arrows in the drawing) by exerting an external force on the fixing base 41 by the user. An upside down U-shaped structure is formed by the first plate 4121, the second plate 4122 and the first fixing base portion 411 after they are folded downward, thereby a size of the water bucket can be smaller and dehydration can be finished faster. A dehydration process of the mop structure 4 and the dehydration device 2 of the invention is shown in FIG. 6*c*.

Figure 7:
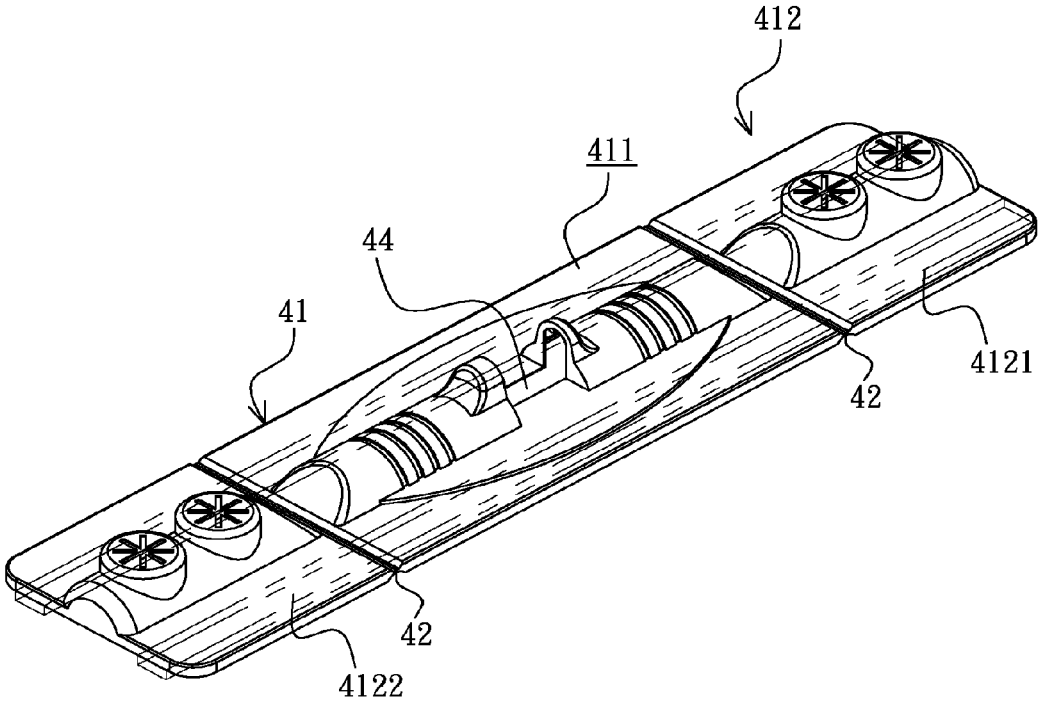
FIG. 7 is an illustration of a positioning unit of the mop structure of an embodiment of the invention.

Referring to FIG. 7, a positioning unit 44 of the mop structure 4 of the invention is shown in the drawing. The positioning unit 44 is disposed at a center position of a bottom surface of the first fixing base portion 411. When the fixing base 41 of the mop structure 4 is placed in the dehydration device 2 (as show in FIG. 6*c*) for dehydration, the fixing base 41 can be positioned securely on the water bucket with the dehydration device by the positioning unit 44, so that the fixing base 41 of the mop structure 4 can be prevented from being thrown out during a high speed spinning when the centrifugal force is too strong. Thereby, a danger of using the mop structure 4 of the invention by the user can be reduced substantially.

Figure 8:
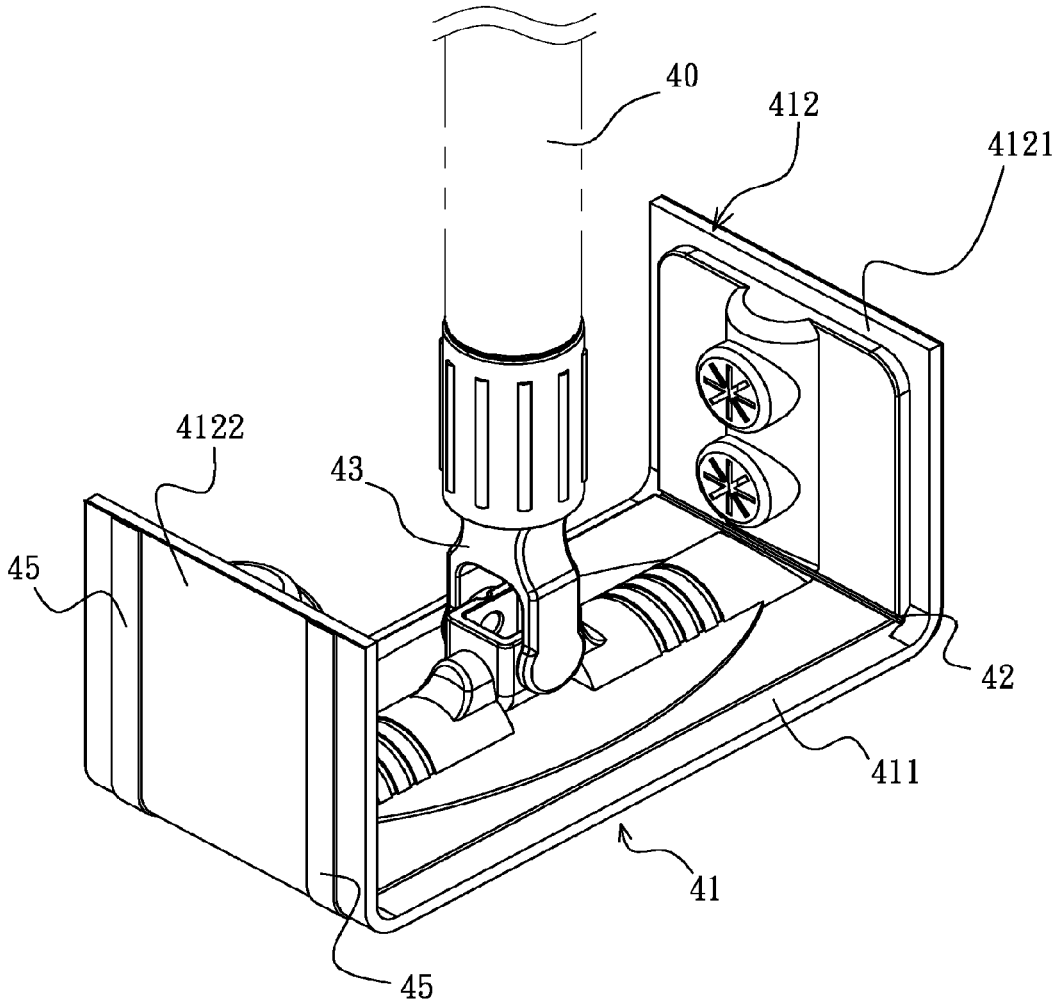
FIG. 8 is an illustration of an adhesive unit of the mop structure of an embodiment of the invention.

Referring to FIG. 8, which is an illustration of the mop structure 4 of the invention with an adhesive unit 45. As shown in the drawing, the adhesive unit 45 is disposed on bottoms of the first fixing base portion 411 and the second fixing base portion 412 for adhering or coupling a cleaning body such as a cloth, a sponge or a cleaning paper so that the cleaning body can be fixed on the first fixing base portion 411 and the second fixing base portion 412, and the adhesive unit 45 can be a material with adhesive characteristic such as a re-closable fastener.

Figure 9:
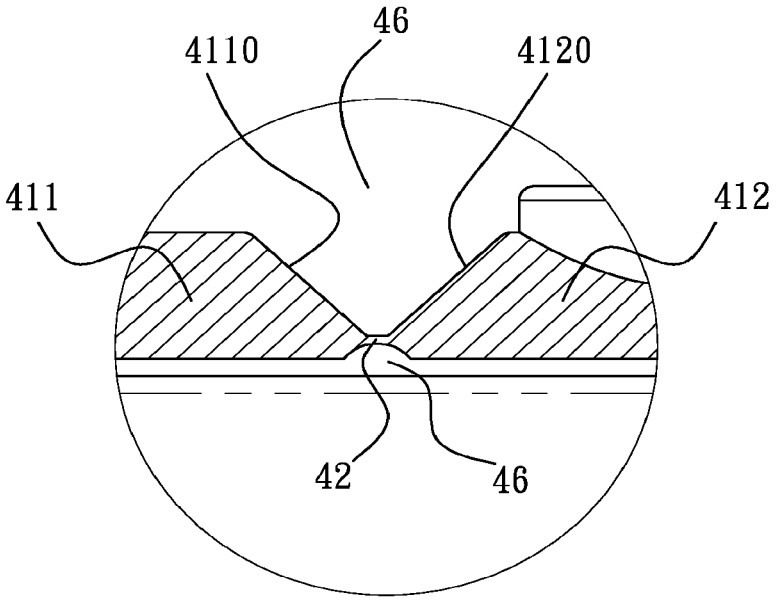
FIG. 9 is an enlarged view of a structure of a connecting portion of the mop structure of an embodiment of the invention.

Referring to FIG. 9, which is an enlarged view of a structure of the connecting portion 42 of the mop structure 4 of the invention. As shown in the drawing, a space 46 is disposed above and below the connecting portion 42 respectively, the space 46 is formed by the connecting portion 42, a lateral side 4110 of the first fixing base portion 411 and a lateral side 4120 of the second fixing base portion 412. When the second fixing base portion 412 is pushed or exerted by an external force, the space 46 is provided for a moving range of the second fixing base portion 412 when it is being folded. A shape of the lateral side 4110 of the first fixing base portion 411 and the lateral side 4120 of the second fixing base portion 412 can be different corresponding to a size of the space 46 required for folding. For example, the lateral side 4110 of the first fixing base portion 411 and the lateral side 4120 of the second fixing base portion 412 above the connecting portion 42 are inclined surfaces, while the lateral side 4110 of the first fixing base portion 411 and the lateral side 4120 of the second fixing base portion 412 below the connecting portion 42 are in arc shapes.

As a conclusion from the above technical description, it is clearly shown that a main technical means of the mop structure 4 of the invention is the connecting portion 42 connected with the first fixing base portion 411 and the second fixing base portion 412, the connecting portion 42 is made of a flexible material and the second fixing base portion 412 can be pushed or exerted by an external force to be folded in a first direction and a second direction because of the flexibility of the connecting portion 42. Because the connecting portion 42, the first fixing base portion 411 and the second fixing base portion 412 are formed in one piece during manufacturing, besides that the costs can be reduced effectively by the mop structure 4 of the invention, a probability of damage can be reduced substantially due to its simple structures.

Below is description of a second embodiment of the mop structure of the invention. Referring to FIGS. 10, 11, 12*a* and 12*b*, a mop structure 5 of the invention has a grip unit 52, a rotational unit 53 and a coupling unit 54.

Figure 10:
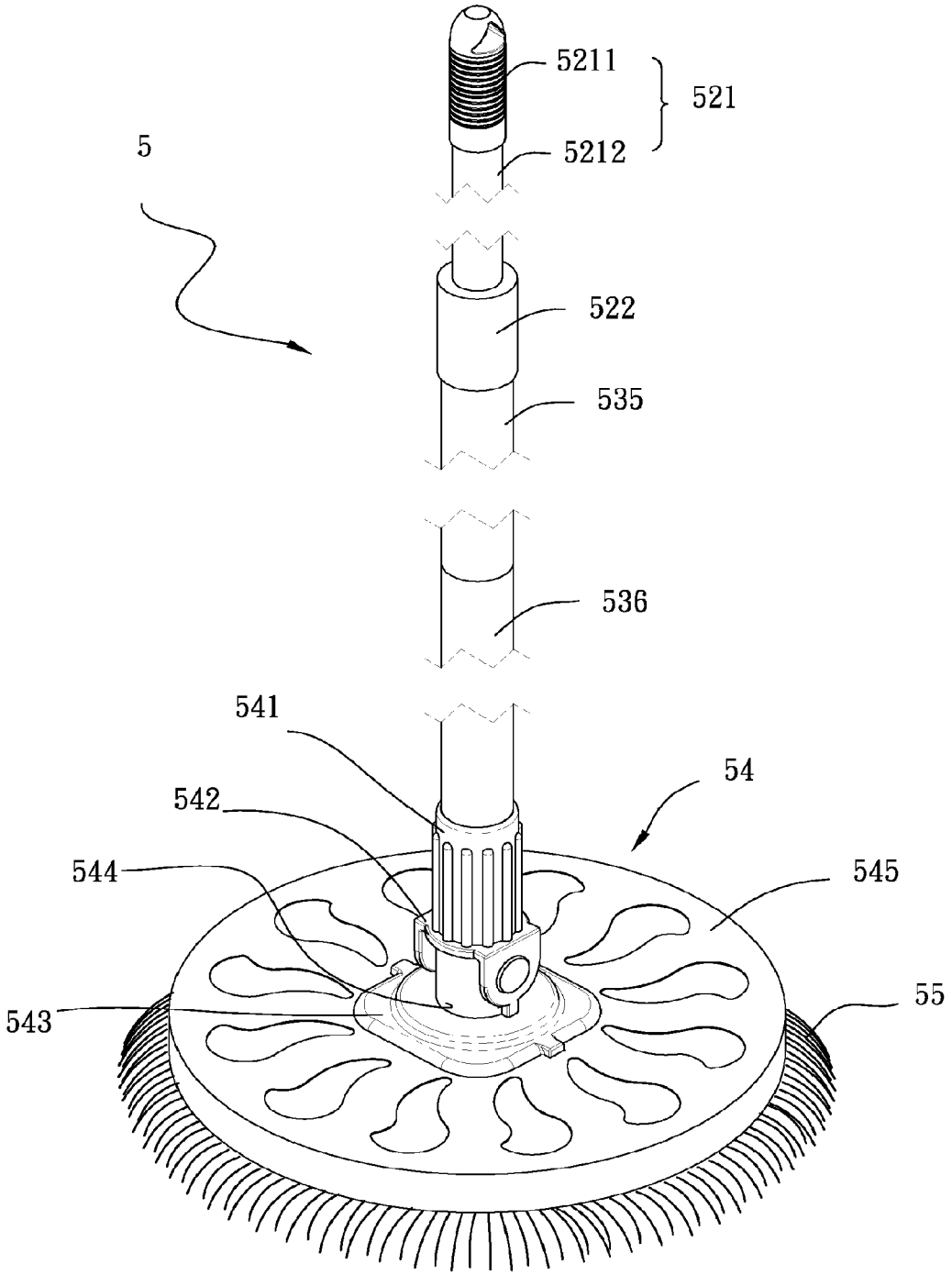
FIG. 10 is an assembling view of the mop structure of a second embodiment of the invention.
Figure 11:
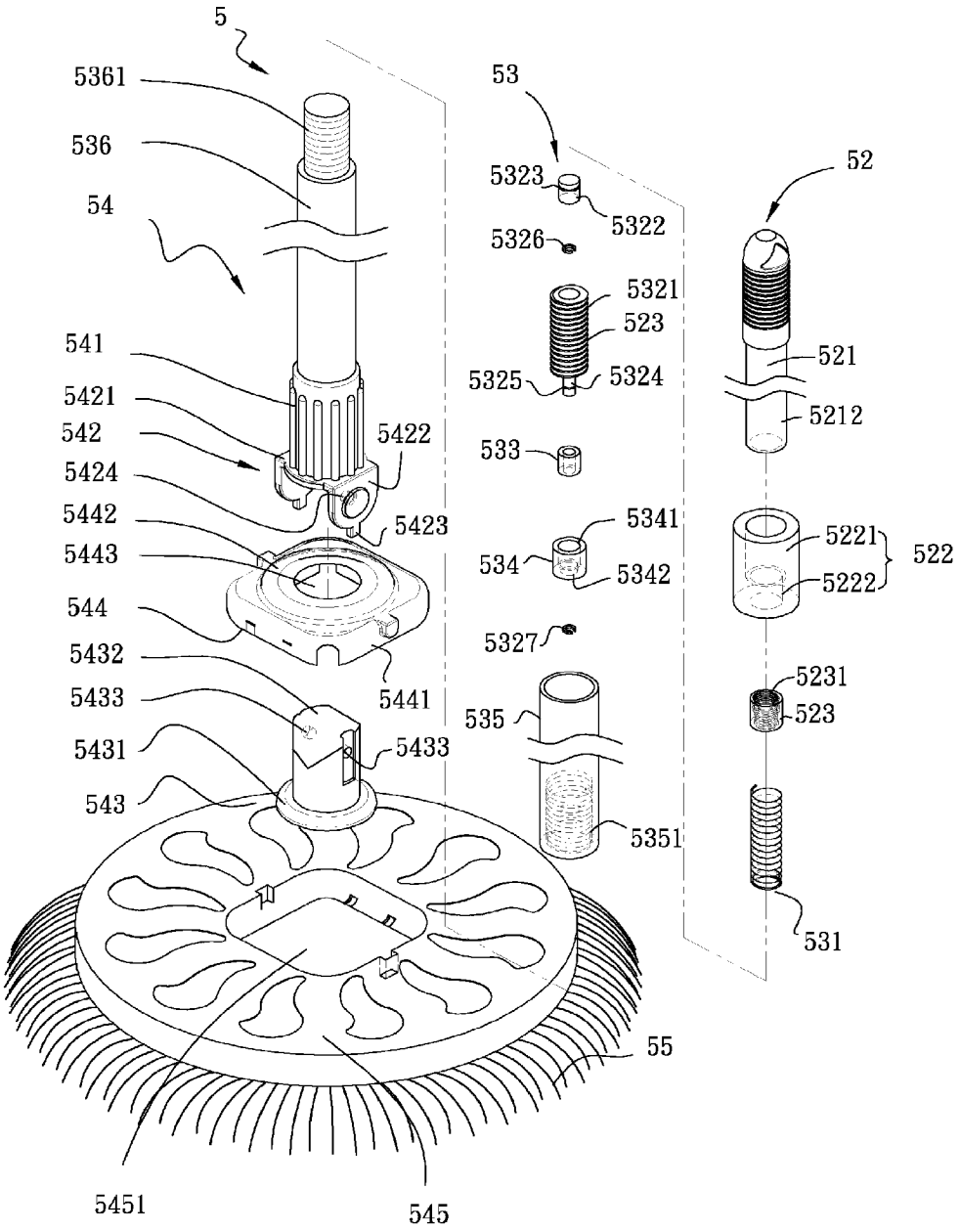
FIG. 11 is an exploded perspective view of the mop structure of the second embodiment of the invention.

The grip unit 52 is disposed at the top as shown in FIG. 10, it is composed of a grip bar 521, a sleeve 522 and a first hollow pole 523. The grip bar 521 is composed of a grip portion 5211 and a hollow bar portion 5212. The sleeve 522 is composed of a first ringed sleeve 5221 and a second ringed sleeve 5222. In inner diameter of the first ringed sleeve 5221 is larger than that of the second ringed sleeve 5222. The first ringed sleeve 5221 is used for fitting on the bar portion 5212 of the grip bar 521. The first pole 523 is fixed inside the bar portion 5212 of the grip bar 521 and the first pole 523 has a first inner thread 5231 disposed on its inner surface.

The rotational unit 53 has a flexible element 531, a screw 532, an unilateral bearing 533, a bearing sleeve 534, a connecting bar 535 and a fixing bar 536. The bearing sleeve 534 has a third ringed sleeve 5341 and a fourth ringed sleeve 5342, and an inner diameter of the third ringed sleeve 5341 is larger than that of the fourth ringed sleeve 5342. The unilateral bearing 533 is accommodated in the third ringed sleeve 5341. The connecting bar 535 is hollow, a second inner thread 5351 is disposed on an inner surface of one end of the connecting bar 535, the bearing sleeve 534 is sleeved against an inner side of another end of the connecting bar 535, and the second ringed sleeve 5222 of the sleeve 522 is sleeved on an outer side of the other end of the connecting bar 535, and a part of the connecting bar 535 is inserted in the grip bar 521. A second outer thread 5361 is formed at an end of the fixing bar 536 for screwing with the second inner thread 5351 of the connecting bar 535.

Two ends of the flexible element 531 and are pressed against a bottom of the first pole 523 and a top of the connecting bar 535 respectively. A first outer thread 5321 is disposed on the screw 532, and a second pole 5322 is closely fitted inside an end of the screw 532, and a first ringed groove 5323 is disposed on the second pole 5322 at a suitable location. A third pole 5324 is extended from another end of the screw 532 axially, a second ringed groove 5325 is disposed on the third pole 5324 at a suitable location. A first ring 5326 and a second ring 5327 are sleeved on the first ringed groove 5323 and the second ringed groove 5325 respectively. The first ring 5326 and the second ring 5327 can be a C-shaped ring but they are not limited to it. The second pole 5322 is disposed inside a top of the screw 532 securely by having the first ring 5326 sleeving on the first ringed groove 5323. An end of the second pole 5322 is closely fitted inside the screw 532, and the screw 532 is penetrated through the sleeve 522 and to have the first outer thread 5321 screwed with the first inner thread 5231 of the first pole 523. An end of the third pole 5324 extended from the screw 532 is gone through the unilateral bearing 533 and the bearing sleeve 534, and is fixed securely at a bottom of the fourth ringed sleeve 5342 by the second ring 5327 ringed on the second ringed groove 5325.

The coupling unit 54 comprises a grip 541, a first movement element 542, a second movement element 543, a positioning element 544 and a coupling base 545, a bottom of the coupling base 545 is connected with a cleaning body 55 such as a cloth, and a coupling groove 5451 is disposed on a top of the coupling base 545.

An end of the grip 541 is connected to an end of the fixing bar 536 of the rotational unit 53 which is further away from the second outer thread 5361, and another end of the grip 541 is connected to the first movement element 542.

The first movement element 542 is roughly or substantially a U-shaped structure and it has a bottom surface 5421 and two lateral surfaces 5422. The bottom surface 5421 is connected to the grip 541, the two lateral surfaces 5422 are roughly or substantially perpendicular to the bottom surface 5421 and are extended from the two sides of the bottom surface 5421 in a direction further away from the fixing bar 536 respectively. A protruded flange 5423 is extended axially from an end of the two lateral surfaces 5422 which is further away from the bottom surface 5421 respectively, and a protruded block 5424 is disposed on an inner side of the two lateral surfaces 5422 respectively.

Figure 12A:
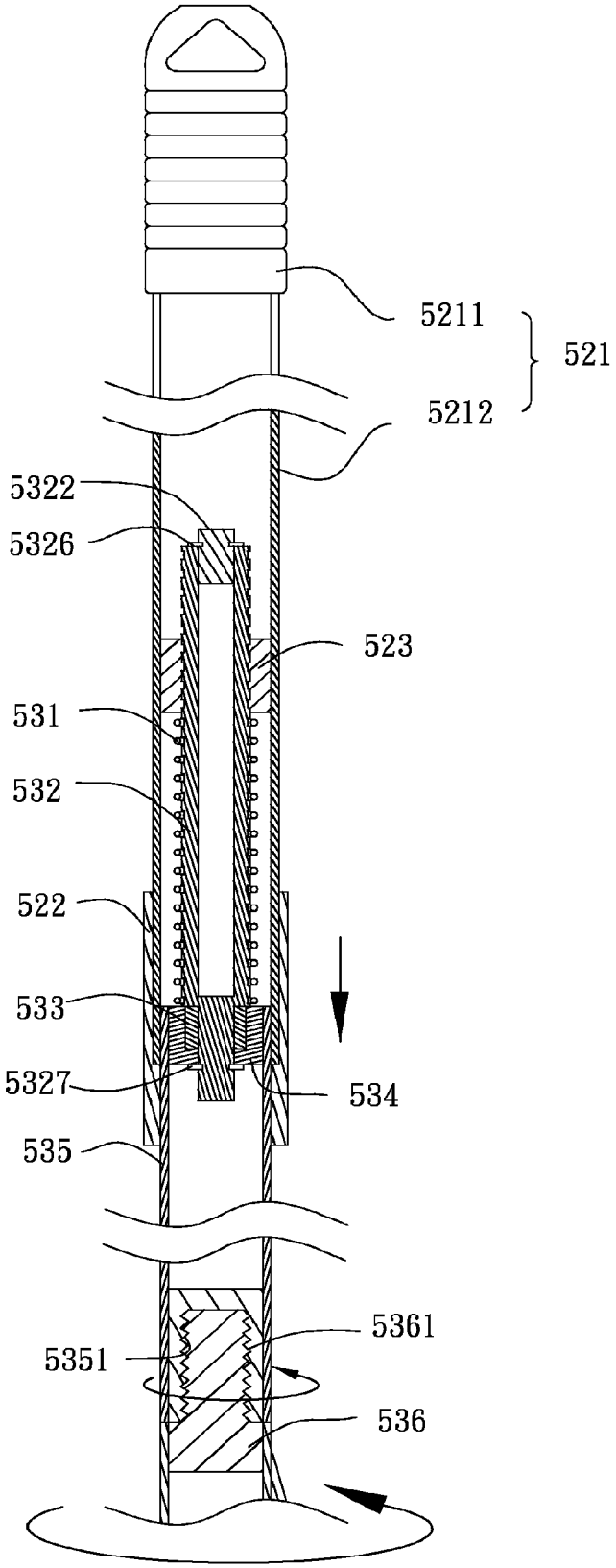
FIG. 12*a* is a partial cross-sectional view of the mop structure of the second embodiment of the invention.
Figure 12B:
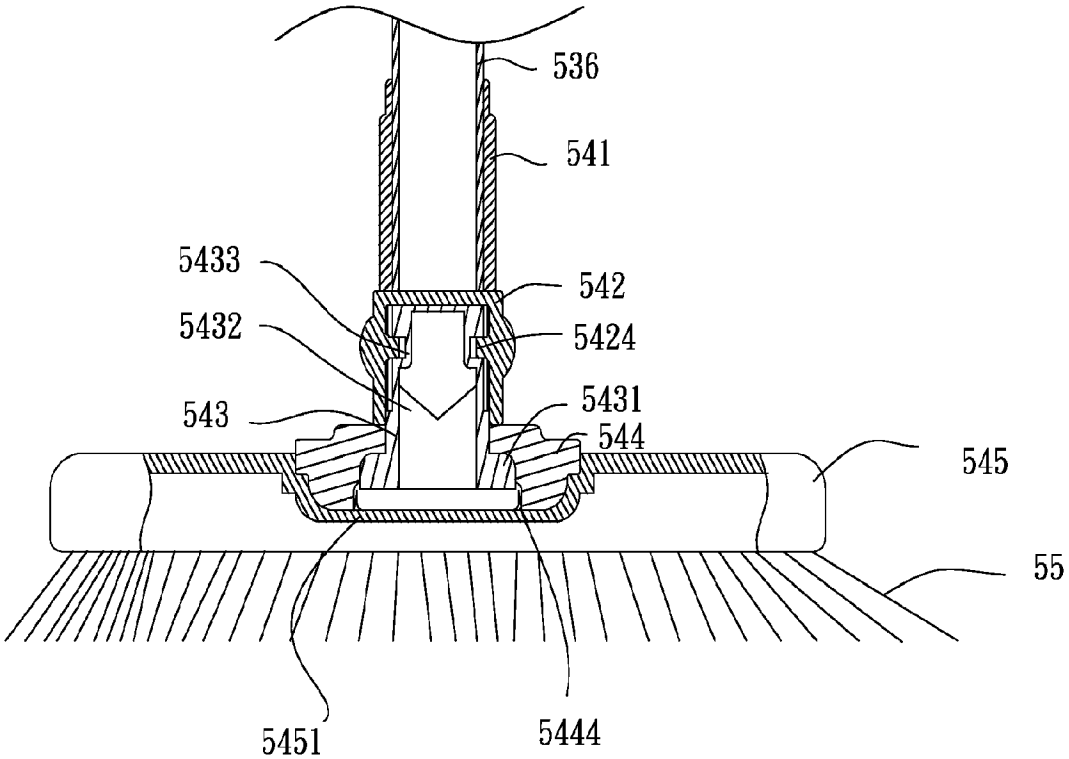
FIG. 12*b* is a partial cross-sectional view of the mop structure of the second embodiment of the invention.

The positioning element 544 is fitted in the coupling groove 5451 removably, and the positioning element 544 has a main body 5441 and a ringed corresponding portion 5442 protruded on the main body 5441. The main body 5441 is an opened type structure and a limiting space 5444 is defined by the main body 5441 assembling with the coupling groove 5451 as shown in FIG. 12*b*. A through hole 5443 is defined by the corresponding portion 5442, and the protruded flange 5423 of the first movement element 542 is pressed against on a top of the corresponding portion 5442.

The second movement element 543 has a circular bottom base 5431 and a coupling pole 5432, a thickness of the bottom base 5431 is smaller than a height of the limiting space 5444, the coupling pole 5432 is disposed on the bottom base 5431, and a pivotal groove 5433 is disposed on two sides of the coupling pole 5432 respectively. The coupling pole 5432 of the second movement element 543 is gone through the through hole 5443 of the positioning element 544, and the protruded block 5424 of the first movement element 542 is fixed pivotally in the pivotal groove 5433, and the bottom base 5431 is accommodated in the limiting space 5444.

When the coupling base 545 is being rotated, an acute angle is included between an axial direction of the first movement element 542 and a plane of the positioning element 544 so as to have the protruded flange 5423 detached from the top of the corresponding portion 5442 of the positioning element 544, so that the coupling base 545 can be rotated pivotally, and dehydration can be processed with the dehydration device.

If the coupling base 545 needs to be fixed, a right angle is included between an axial direction of the first movement element 542 and a plane of the positioning element 544 so as to have the protruded flange 5423 pressed against the top of the corresponding portion 5442 of the positioning element 544, and the protruded block 5424 of the first movement element 542 is fixed pivotally in the pivotal groove 5433 so as to have the bottom base 5431 of the second movement element 543 closely fitted with the corresponding portion 5442 of the positioning element 544, and therefore the coupling base 545 is fixed tightly.

Figure 13:
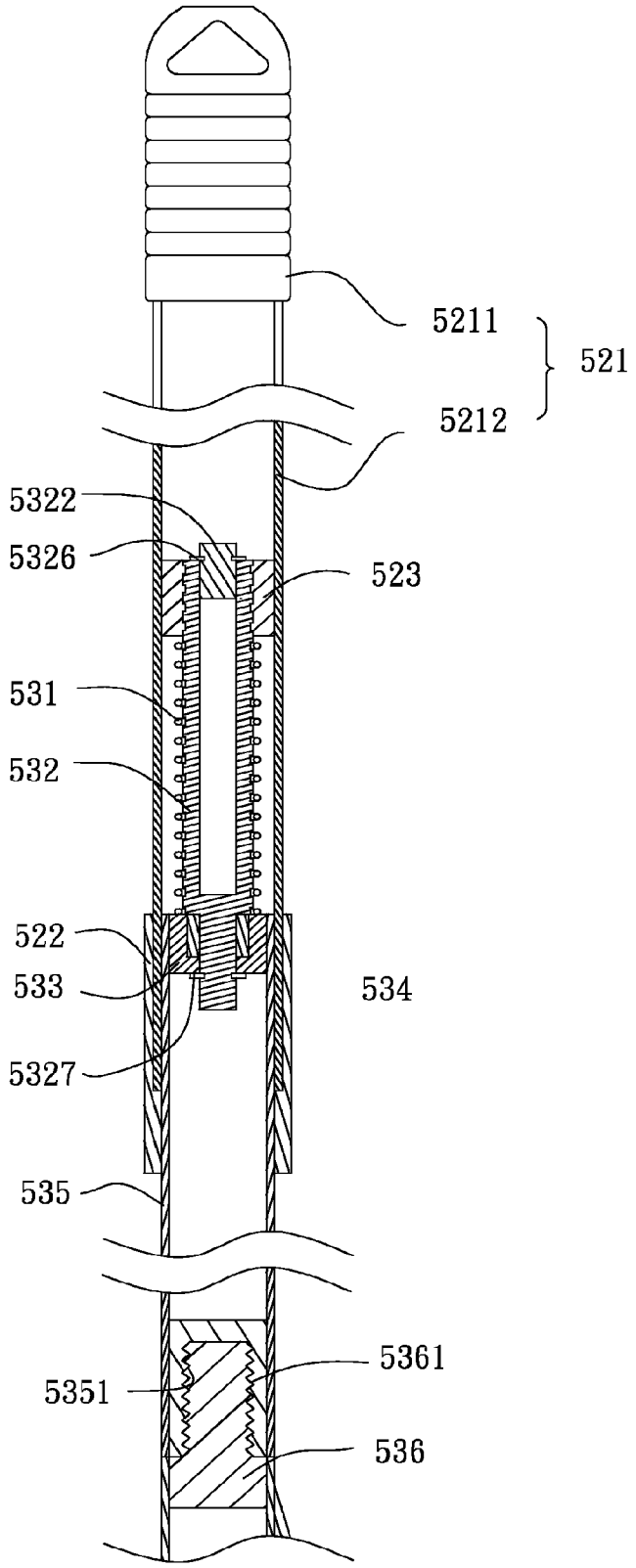
FIG. 13 is a partial cross-sectional view of the mop structure of the second embodiment of the invention in operation.
Figure 14:
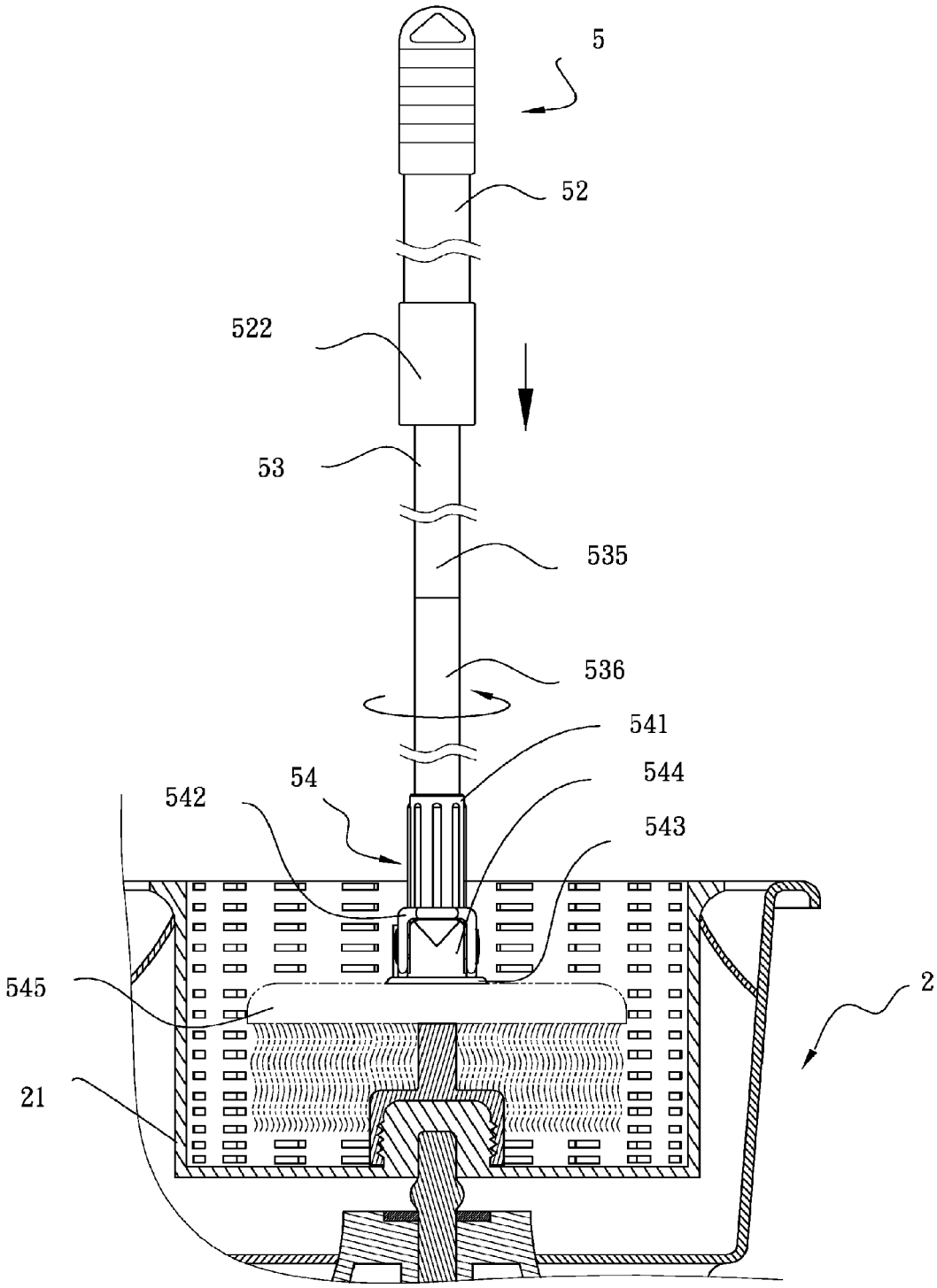
FIG. 14 is an illustration of the mop structure of the second embodiment combined with the dehydration device of the invention.

Referring to FIGS. 13 and 14, FIG. 13 is a partial cross-sectional view of the invention when it is being used, and FIG. 14 is an illustration of the mop structure combined with the dehydration device of the invention.

When dehydration is processed or activated by the user, firstly, the coupling base 545 has to be tightly fixed and the coupling base 545 and the connected cleaning body 55 (e.g. a cloth for mopping) are placed in the dehydration device 2. The dehydration device 2 has the mop supporting unit 21, and the coupling base 545 and the connected cleaning body 55 (e.g. a cloth for mopping) are placed in the mop supporting unit 21. Then, the grip bar 521 is pressed downward, and the flexible element 531 is pressed by a bottom of the first pole 523 and a top of the connecting bar 535, and the first inner thread 5231 and the first outer thread 5321 react correspondingly, so that the rotational unit 53 and the coupling unit 54 are rotated synchronously in a single direction A (e.g. clockwise or anti-clockwise). Then, by an elasticity of the flexible element 531, and with an effect of the first inner thread 5231, the first outer thread 5321 and the unilateral bearing 533, the grip bar 521 is moved upward automatically, and the rotational unit 53 and the coupling unit 54 are rotated synchronously in a single direction A. Because regardless of an upward or a downward movement of the grip 541, the rotational unit 53 and the coupling unit 54 are rotated synchronously in a single direction A, and the mop supporting unit 21 is also rotated, and the water in the cleaning body 55 can then be dehydrated by the centrifugal force by spinning, and the dehydration can be processed conveniently, safely and is also effort-saving.

Because of the elasticity of the flexible element 53, the bottom of the first pole 523 and the top of the connecting bar 535 are pressed, so that a fixed distance is maintained between the grip unit 52 and the rotational unit 53, making it convenient for the user to perform mopping of a floor by the user.

Figure 15:
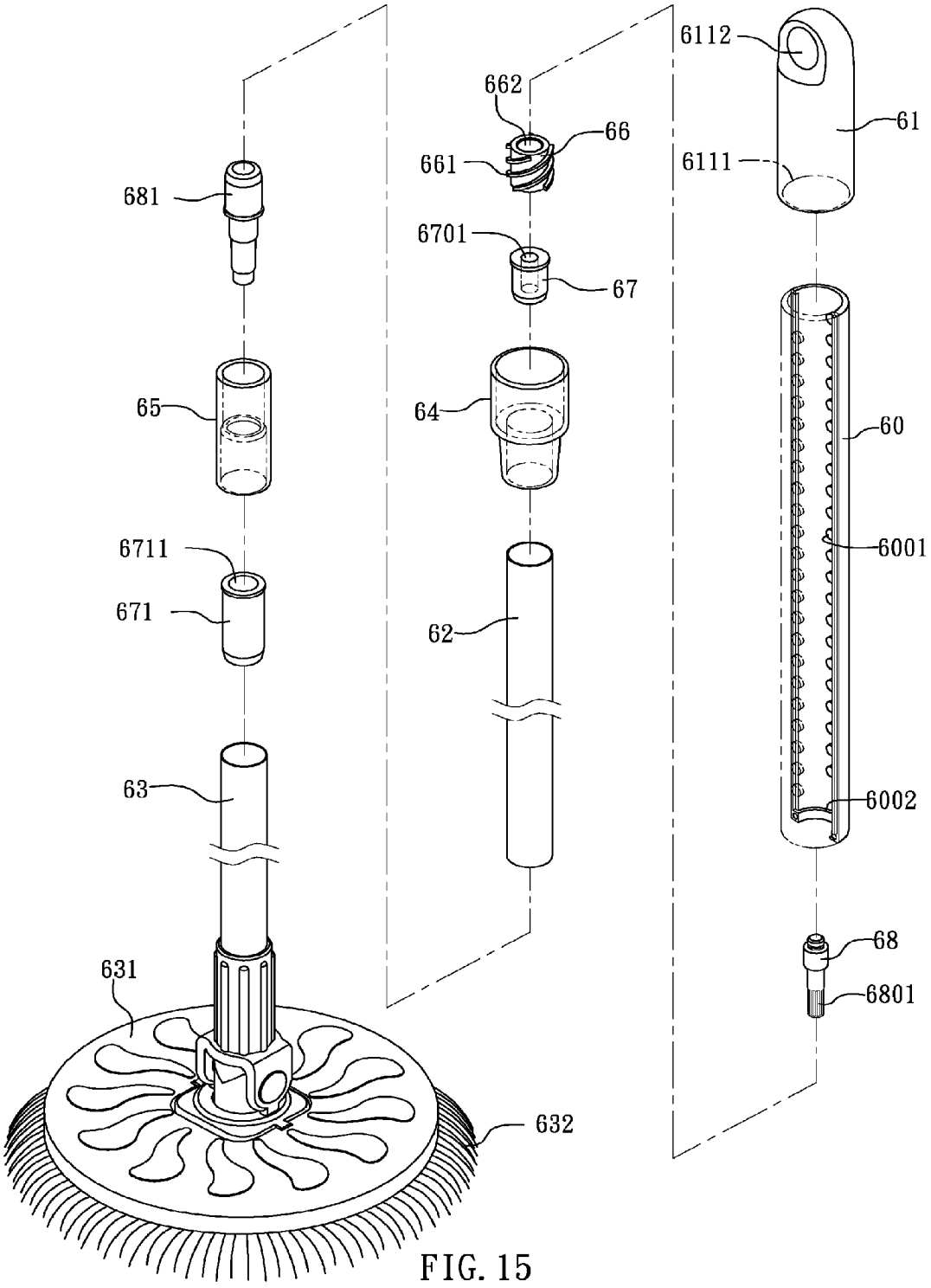
FIG. 15 is an exploded perspective view of the mop structure of a third embodiment of the invention.
Figure 16:
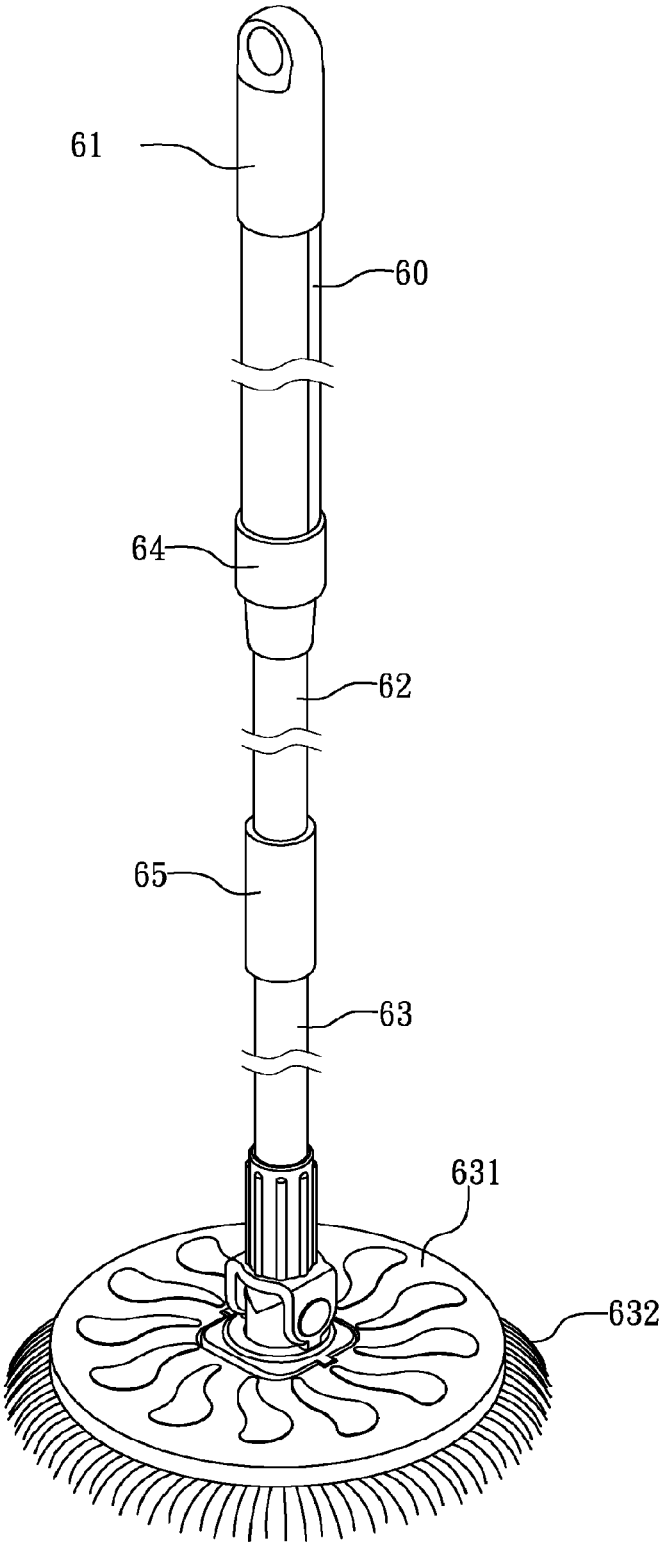
FIG. 16 is a perspective view of the mop structure of the third embodiment of the invention.
Figure 17:
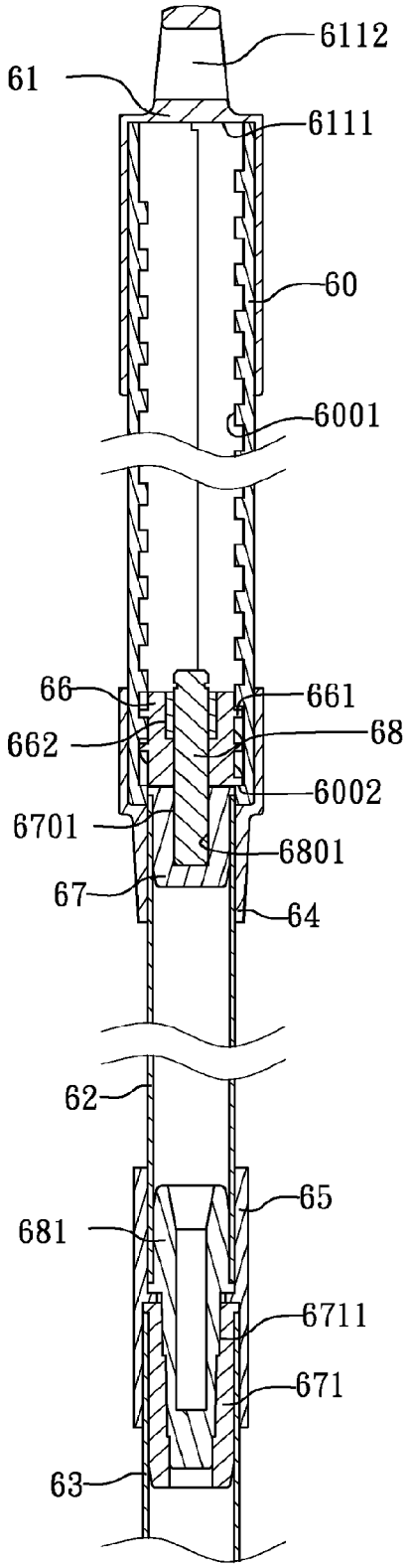
FIG. 17 is a partial cross-sectional view of the mop structure of the third embodiment of the invention.
Figure 18:
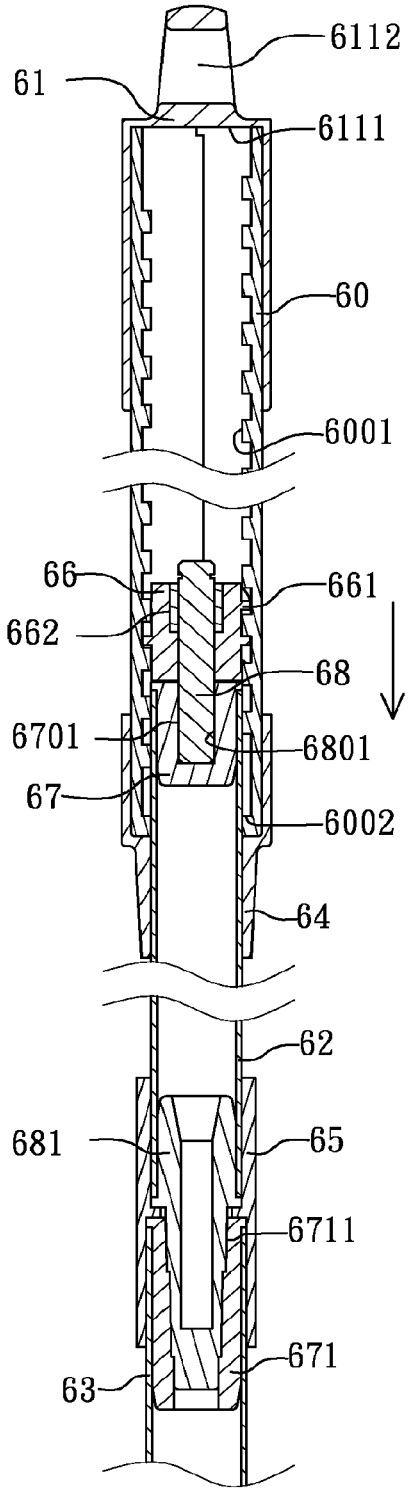
FIG. 18 is a partial cross-sectional view of the mop structure of the third embodiment of the invention in operation.

Below is a description of a third embodiment of the mop structure of the invention. Referring to FIGS. 15 to 17, the mop structure of the invention includes a first sleeve tube 60, a plurality of protruded limiting dots 6001 is disposed on an inner surface of the first sleeve tube 60, the protruded limiting dots 6001 are arranged in two corresponding rows alternatively with a same distance between the dots in two rows respectively as shown in FIG. 15, a protruded limiting flange 6002 is disposed at an end on the inner surface of the first sleeve tube 60; a grip sleeve 61, an accommodating hole 6111 is disposed at an end of the grip sleeve 61, a hanging hole 6112 is disposed at another end of the grip sleeve 61, the accommodating hole 6111 is for the first sleeve tube 60 to be inserted into and the hanging hole 6112 is for hanging; a second sleeve tube 62 disposed below the first sleeve tube 60, and the second sleeve tube 62 can be moved inside the first sleeve tube 60 retractably; a third sleeve tube 63 disposed below the second sleeve tube 62, a rotational disc set 631 is fitted at an end of the third sleeve tube 63 and the rotational disc set 631 has a mopping cloth 632; a first connecting sleeve 64 disposed between the first sleeve tube 60 and the second sleeve tube 62, so that the second sleeve tube 62 is an extension of the first sleeve tube 60, and they will not be detached from each other; a second connecting sleeve 65 disposed between the second sleeve tube 62 and the third sleeve tube 63, so that the third sleeve tube 63 is an extension of the second sleeve tube 62, and they will not be detached from each other; a lead screw 66 disposed in the first sleeve tube 60, at last one thread 661 is disposed around the lead screw 66 and a though hole 662 is disposed in the lead screw 66; a first inserting pole 67 made of an elastic material, the first inserting pole 67 has a first inserting hole 6701; a second inserting pole 671 made of an elastic material, the second inserting pole 671 has a second inserting hole 6711; a first positioning bolt 68 disposed in the through hole 662, a thread section 6801 is disposed at an end of the first positioning bolt 68, the thread section 6801 is screwed and fixed in the first inserting hole 6701 so that the lead screw 66 and the first inserting pole 67 are connected together; and a second positioning bolt 681 disposed in the second connecting sleeve 65, an end of the second positioning bolt 681 is inserted in the second inserting hole 6711 so that the second sleeve tube 62 and the third sleeve tube 63 are connected together.

The structures, positions and relationships of connection of the elements of the invention are described above. The coupling between the elements and the expected effects are described below.

Referring to FIGS. 15 to 17 and FIG. 18, the invention is composed of the abovementioned elements. Firstly, the second inserting pole 671 and the second positioning bolt 681 are inserted in an upper end of the third sleeve tube 63 and a bottom end of the second sleeve tube 62 respectively, then the second sleeve tube 62 and the third sleeve tube 63 are connected together by the second connecting sleeve 65.

The first positioning bolt 68 is gone through the through hole 662 and all the way to the first inserting hole 6701, and first positioning bolt 68 is screwed and fixed in the first inserting hole 6701 through the thread section 6801 so that the lead screw 66 and the first inserting pole 67 are connected together, then the lead screw 66 and the first inserting pole 67 are fitted in the first sleeve tube 60 and the second sleeve tube 62 respectively, so that the first sleeve tube 60 and the second sleeve tube 62 are connected together, and the lead screw 66 is disposed in the first sleeve tube 60, and the thread 661 is disposed between the protruded limiting dots 6001, and the thread 661 can be moved spirally between the protruded limiting dots 6001, and the lead screw 66 is rotated upwardly and downwardly in and the first sleeve tube 60. For assembly, the grip sleeve 61 is then fitted on a top end of the first sleeve tube 60.

Figure 19:
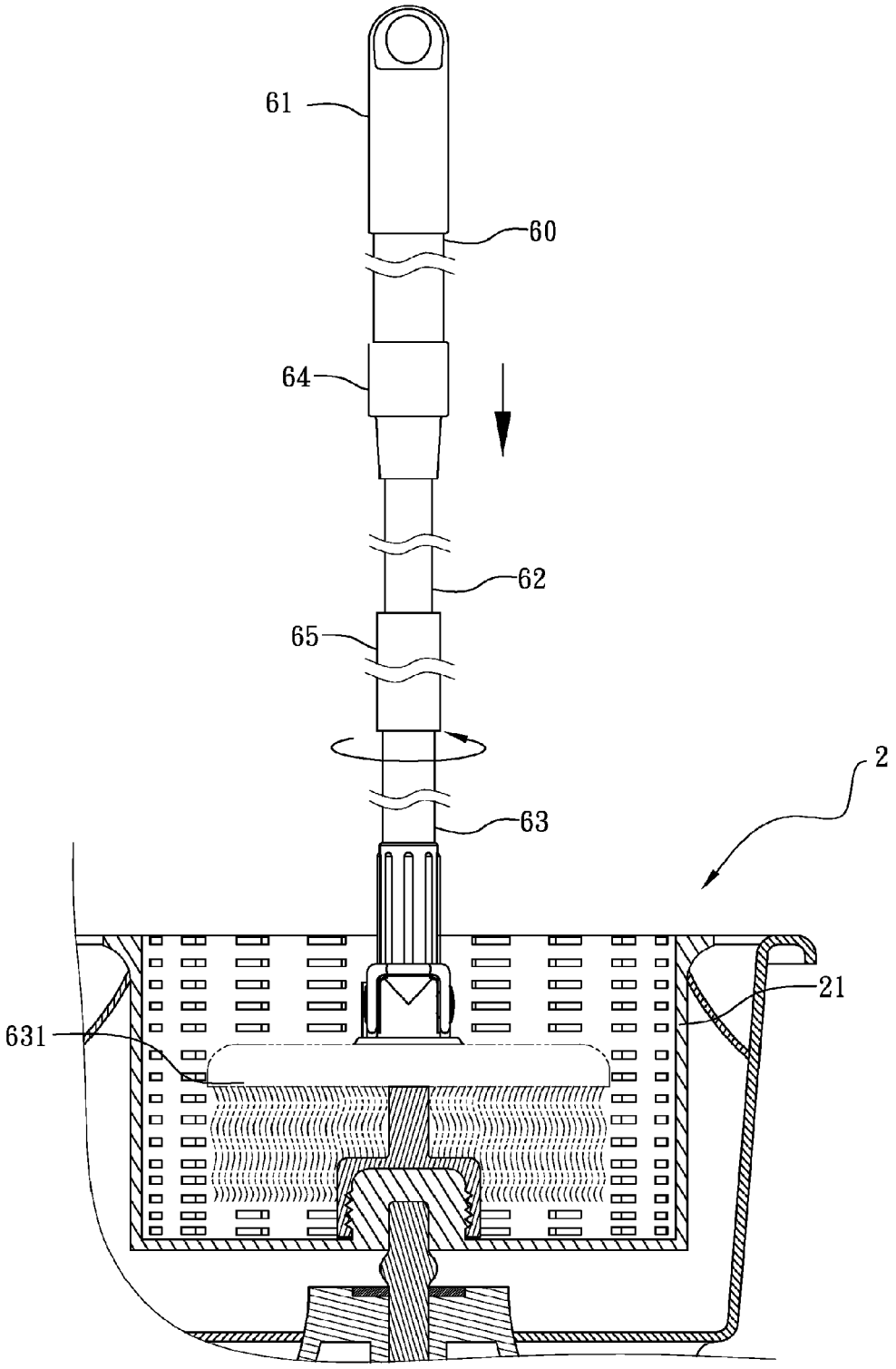
FIG. 19 is an illustration of the mop structure of the third embodiment of the invention being used.

If excess water in the mopping cloth 632 needs to be dehydrated, there are few steps need to be taken, firstly, the invention is placed in the mop supporting unit 21 as shown in FIG. 19, a force is exerted on the grip sleeve 61 downwardly by one hand, so that the second sleeve tube 62 is drawn back inwardly towards the first sleeve tube 60 to have the lead screw 66 being pushed, so that the thread 661 is moved spirally between the protruded limiting dots 6001, and the lead screw 66 is rotated upwardly and downwardly in the first sleeve tube 60, and the second sleeve tube 62 is retracted inwardly and spirally towards the first sleeve tube 60, the third sleeve tube 63 and the rotational disc set 631 are then rotated correspondingly, therefore excess water in the mopping cloth 632 is dehydrated by spinning in the mop supporting unit 21.

Because the thread 661 of the lead screw 66 is moved spirally between the protruded limiting dots 6001, and the rotational disc set 631 is being rotated, therefore the mopping cloth 632 can be dehydrated with ease.

The lead screw 66 is a small structure, and it has a low cost and is not easy to be damaged, therefore a life expectancy of the invention can be prolonged.

Figure 20:
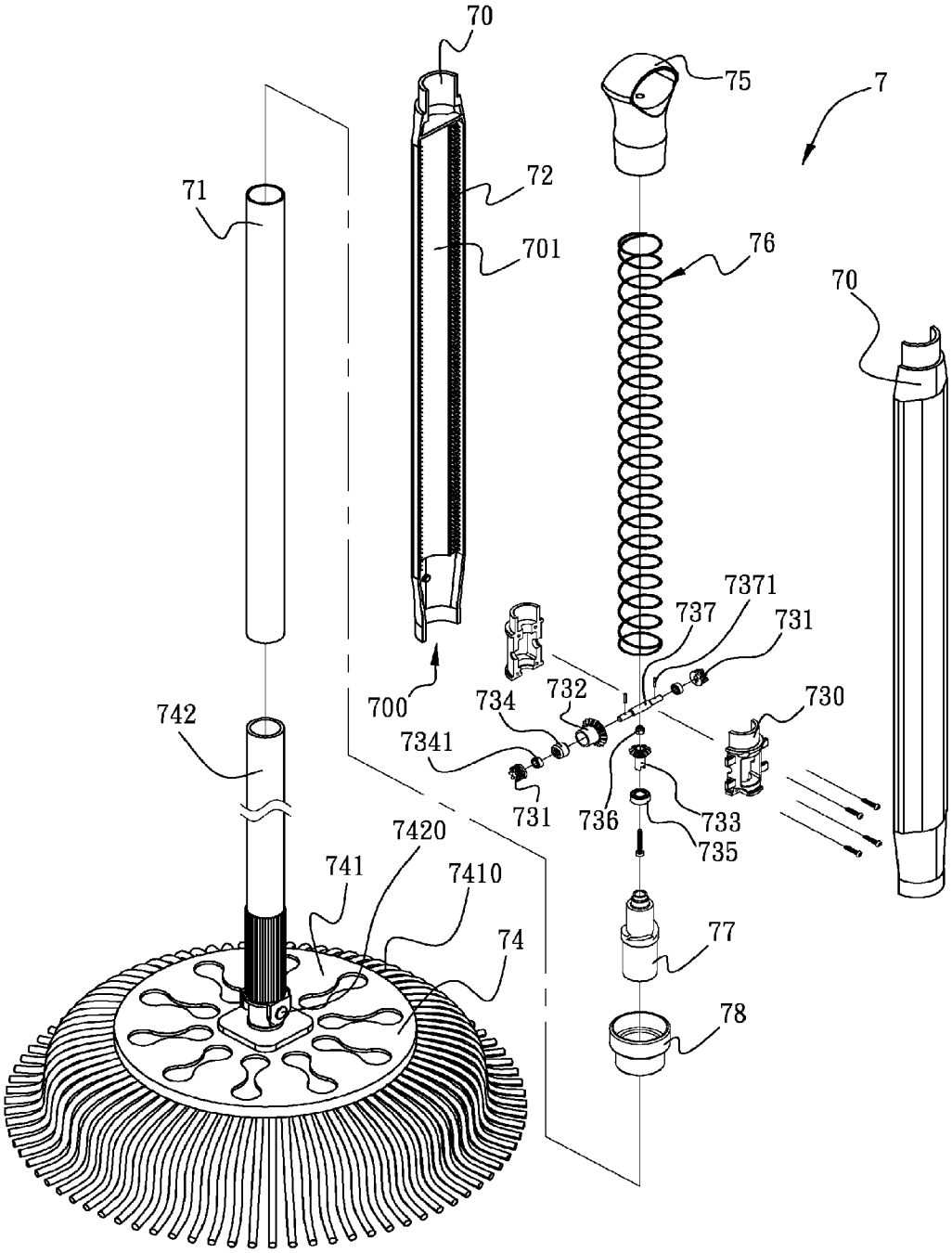
FIG. 20 is an exploded perspective view of the mop structure of a fourth embodiment of the invention.
Figure 21:
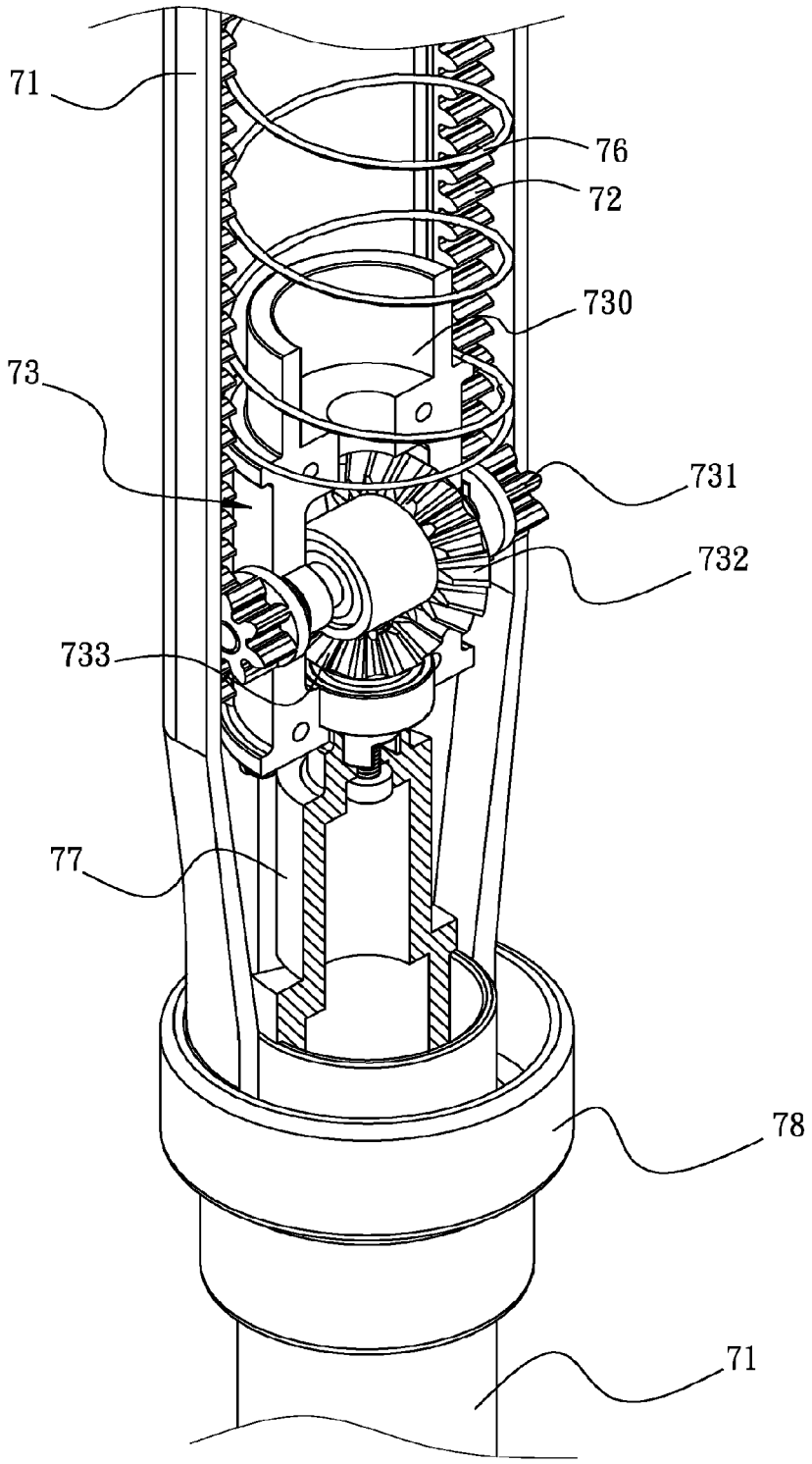
FIG. 21 is a perspective sectional view of the mop structure of the fourth embodiment of the invention.

Below is a description of a fourth embodiment of the invention. Referring to FIGS. 20 and 21, which are an exploded perspective view and a perspective sectional view of the invention respectively. A mop structure 7 of the invention comprises an external bar 70, an internal bar 71, a unit of teeth 72, a driving gear set 73 and a mopping disc 74. The external bar 70 is hollow and an opening 700 is formed at its bottom end, the unit of teeth 72 is disposed on an inner surface 701 of the external bar 70. The internal bar 71 is hollow, an outer diameter of the internal bar 71 is smaller than an inner diameter of the external bar 70, so that the internal bar 71 can be disposed in the external bar 70 rotationally through the opening 700 at the bottom end of the external bar 70, and the mopping disc 74 is fixed at a bottom end of the internal bar 71. A main technical means of the invention is the driving gear set 73 connected with the unit of teeth 72 and the internal bar 71, the driving gear set 73 comprises a first gear 731, a second gear 732 and a third gear 733, the first gear 731 is meshed with the unit of teeth 72, the second gear 732 is meshed with the first gear 731 and the third gear 733 respectively, and the second gear 732 is bigger than the first gear 731 and the third gear 733. By an external force, the first gear 731 is moved in a first direction along the unit of teeth 72, so that the third gear 733 is driven to rotate by the second gear 732, and the internal bar 71 is rotated in a second direction in the external bar 70. Detailed structures of the rotational mop structure 7 of the invention will be described below.

Continuing from the above technical description, the driving gear set 73 of the mop structure 7 of the invention further comprises a case 730, a first unilateral bearing 734, a second unilateral bearing 735, an anti-loose nut set 736 and a shaft 737. The case 730 is used for fixing the first gear 731, the second gear 732 and the third gear 733, the second gear 732 and the third gear 733 are disposed in the case 730, and the second gear 732 is partially exposed outside the case 730. The first unilateral bearing 734 is connected with the first gear 731 through a bearing 7341, a main function of the first unilateral bearing 734 is to have the first gear 731 meshed with the unit of teeth 72 unidirectionally to move. The second unilateral bearing 735 is connected with the third gear 733, a main function of the second unilateral bearing 735 is to have the third gear 733 meshed with the second gear 732 unidirectionally to move. The anti-loose nut set 736 is used for fixing the third gear 733 and the second unilateral bearing 735, in order to prevent the third gear 733 from getting loosed in rotating (the anti-loose nut set 736 is composed of an anti-loose nut and a screw with matching dimensions as shown in the drawings). The shaft 737 is penetrated through the first gear 731, the first unilateral bearing 734, the bearing 7341 and the second gear 732, and a fixing pole 7371 is used for fixing the first gear 731, the first unilateral bearing 734, the bearing 7341 and the second gear 732, and the first gear 731 and the second gear 732 can be rotated around the shaft 737 as their center.

Continuing from the above technical description, the rotational mop structure 7 of the invention further comprises a sleeve 75, a spring 76, an internal bar fixing element 77 and a buffer sleeve 78. The sleeve 75 is fitted on a top end of the external bar 70 for enhancing a stability of the external bar 70. The spring 76 is disposed in the external bar 70 and is connected on the case 730 of the driving gear set 73, the spring 76 is used for pushing the first gear 731 in a third direction along the unit of teeth 72 by its elasticity (i.e. pushing the driving gear set 73 back to its original position). The internal bar fixing element 77 is fixed inside a top end of the internal bar 71, and the internal bar fixing element 77 is locked with the third gear 733 by the anti-loose nut set 736. When the first gear 731 is moved toward the first direction along the unit of teeth 72, the second gear 732 and the third gear 733 are also driven, so that the internal bar 71 is driven by the internal bar fixing element 77 to rotate in the second direction. The buffer sleeve 78 is fitted on a top end of the internal bar 71, when the internal bar 71 is moved inside the external bar 70, the external bar 70 can be prevented from colliding with the mopping disc 74 by the buffer sleeve 78. Furthermore, the mopping disc 74 comprises a fur fixing disc 741 and an internal bar connecting element 742, a mopping fur 7410 is connected to a bottom of the fur fixing disc 741. The internal bar connecting element 742 is connected with the internal bar 71, and the internal bar connecting element 742 is connected pivotally with the fur fixing disc 741 through a pivotal unit 7420.

Figure 22:
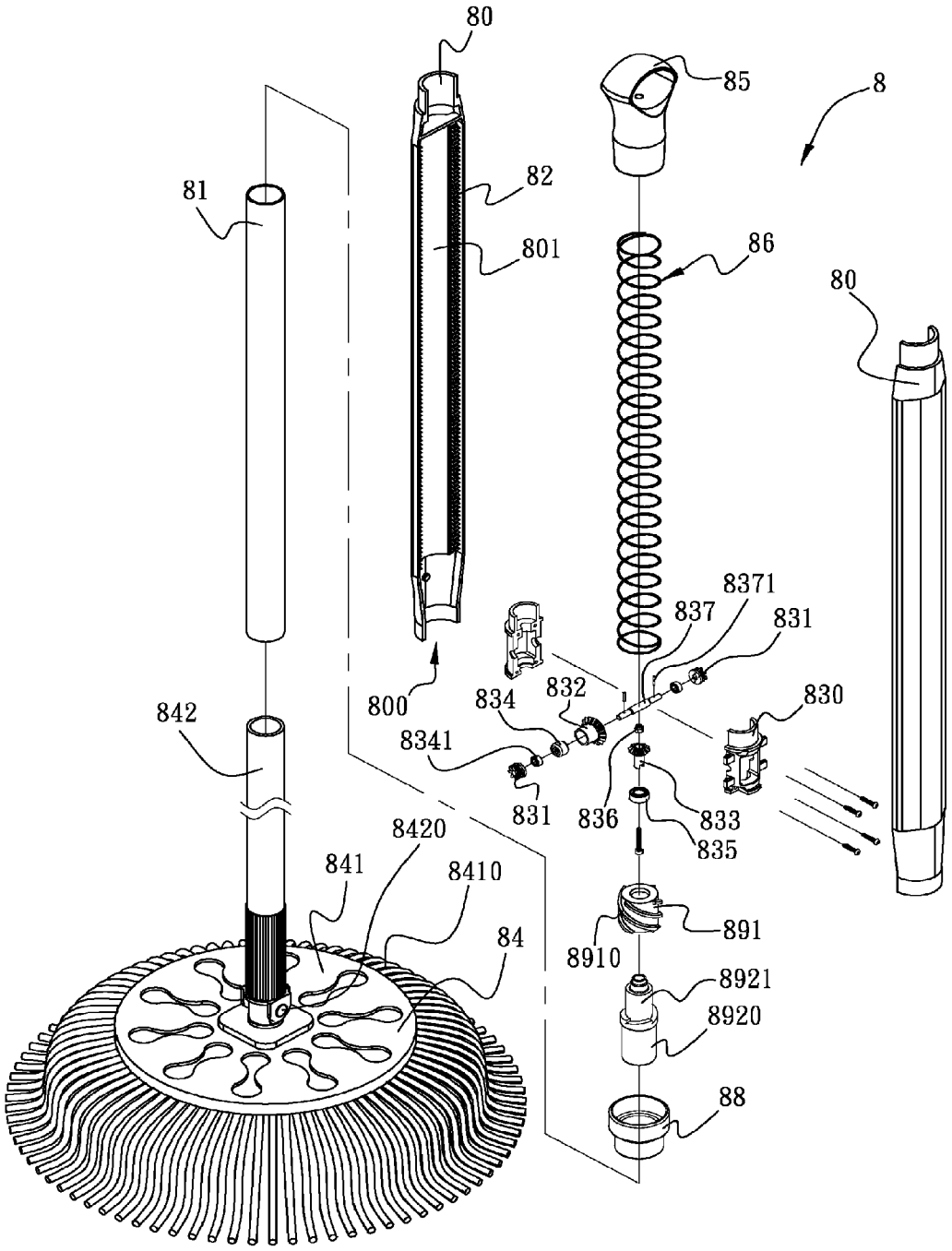
FIG. 22 is an exploded perspective view of the mop structure of a fifth embodiment of the invention.
Figure 23:
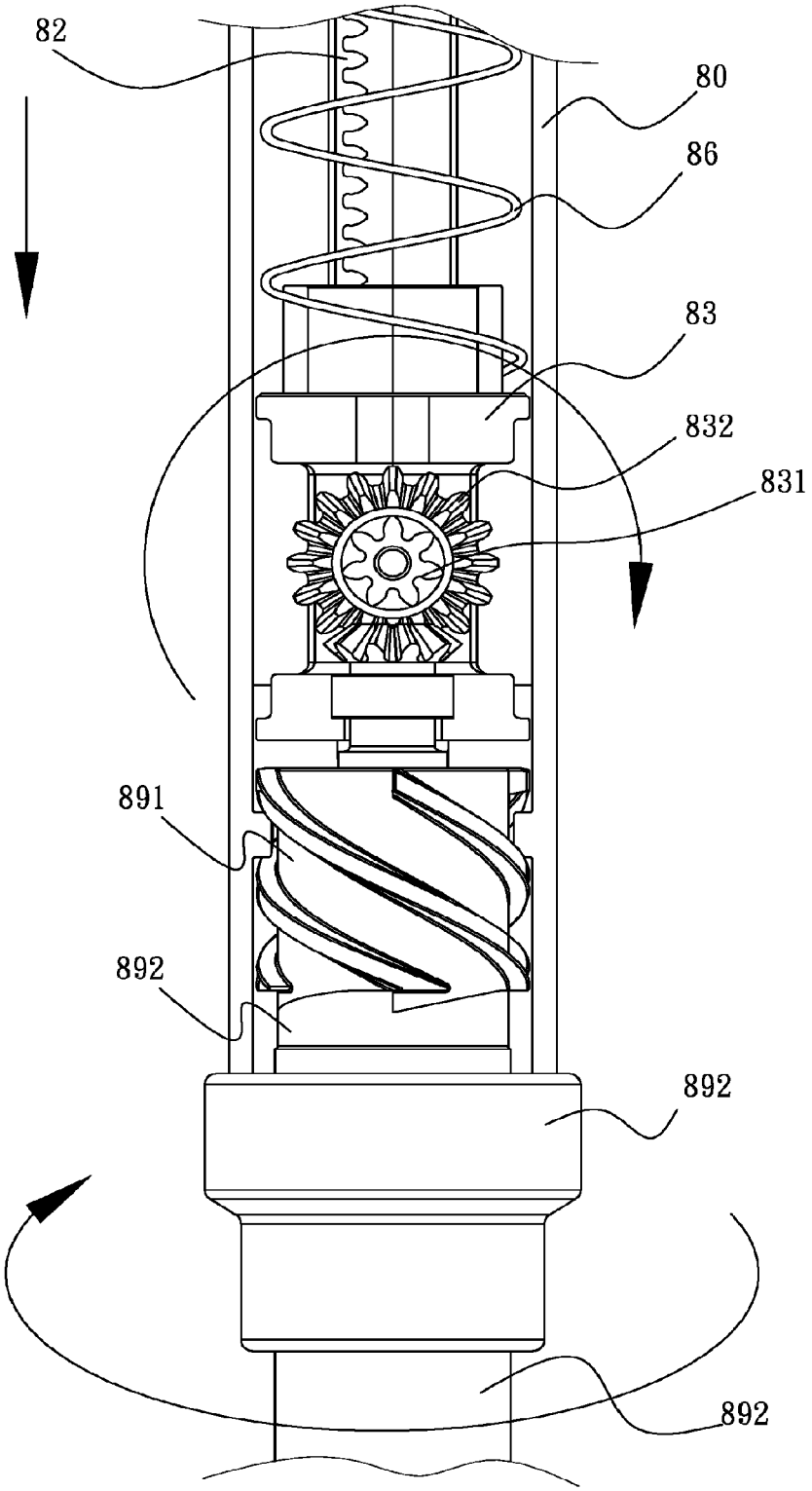
FIG. 23 is a partial perspective cross-sectional view of the mop structure of the fifth embodiment of the invention.

Referring to FIGS. 22 and 23, which are an exploded perspective view and a perspective sectional view of a fifth embodiment of the invention respectively, and the fifth embodiment is different from the fourth embodiment partially. It is clearly shown in the drawings that, a mop structure 8 of the embodiment comprises an external bar 80, an internal bar 81, a unit of teeth 82, a driving gear set 83, a mopping disc 84, a sleeve 85 and a spiral unit 89. The external bar 80 is hollow and an opening 800 is formed at its bottom end, the unit of teeth 82 is disposed on an inner surface 801 of the external bar 80. The internal bar 81 is hollow, an outer diameter of the internal bar 81 is smaller than an inner diameter of the external bar 80, so that the internal bar 81 can be disposed in the external bar 80 rotationally through the opening 800 at the bottom end of the external bar 80, and the mopping disc 84 is fixed at a bottom end of the internal bar 81. The driving gear set 83 is connected with the unit of teeth 82 and the internal bar 81, the driving gear set 73 comprises a first gear 831, a second gear 832 and a third gear 833, the first gear 831 is meshed with the unit of teeth 82, the second gear 832 is meshed with the first gear 831 and the third gear 833 respectively, and the second gear 832 is bigger than the first gear 831 and the third gear 833. By an external force, the first gear 831 is moved in a first direction along the unit of teeth 82, so that the third gear 833 is driven to rotate by the second gear 832, and the internal bar 81 is rotated in a second direction in the external bar 80.

Continuing from the abovementioned description, a main technical means of the embodiment is the third gear 833 of the driving gear set 83 and the spiral unit 89 of the internal bar 81. The spiral unit 89 comprises a spiral sleeve 891 and an internal bar fixing element 892, a thread 8910 is disposed on a surface of the spiral sleeve 891, the spiral sleeve 891 is sleeved on a top of the internal bar fixing element 892, and a thread fitting portion 8920 of the internal bar fixing element 892 is fitted with the thread 8910, and a bottom of the internal bar fixing element 892 is fixed inside a top of the internal bar 81, and is locked with the third gear 833 through an anti-loose nut set 836. When the first gear 831 is moved in the first direction along the unit of teeth 82, the second gear 832 and the third gear 833 are driven, and the spiral sleeve 891 is driven by the third gear 833, and the internal bar fixing element 892 is driven to rotate because its thread fitting portion 8920 is fitted with the thread 8910 of the spiral sleeve 891, so that the internal bar 81 is rotated in the second direction. Some of the elements in this embodiment are the same as those in the fourth embodiment, which will not be mentioned herein again.

Figure 24A:
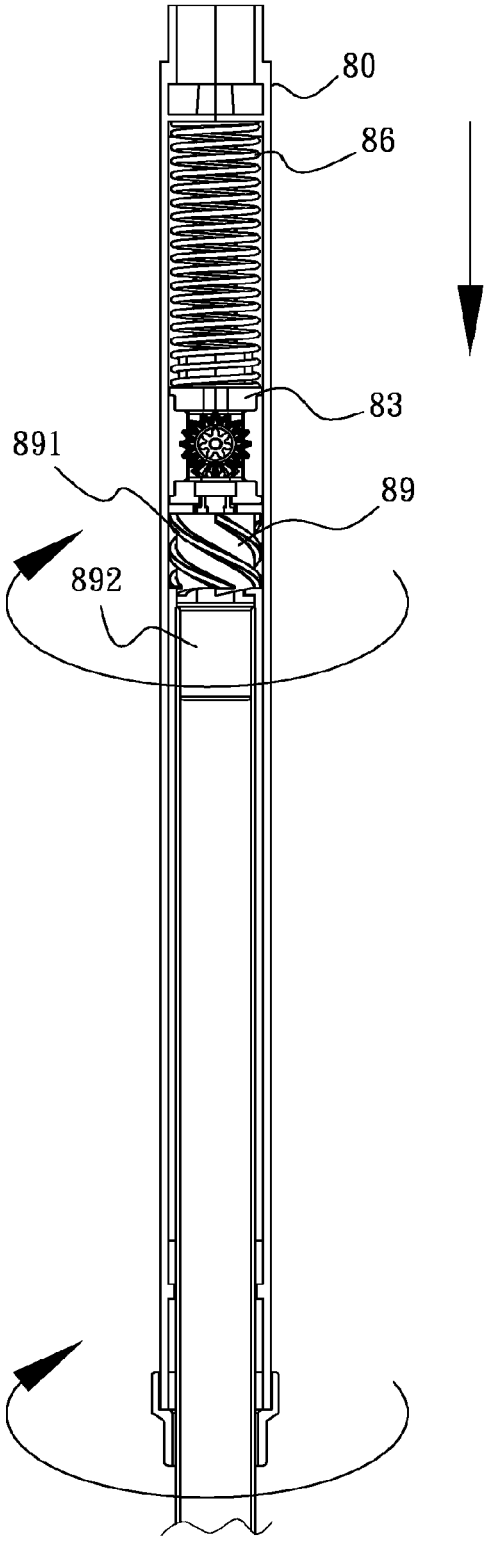
FIG. 24*a* is an illustration of the mop structure of the fifth embodiment of the invention in operation.
Figure 24B:
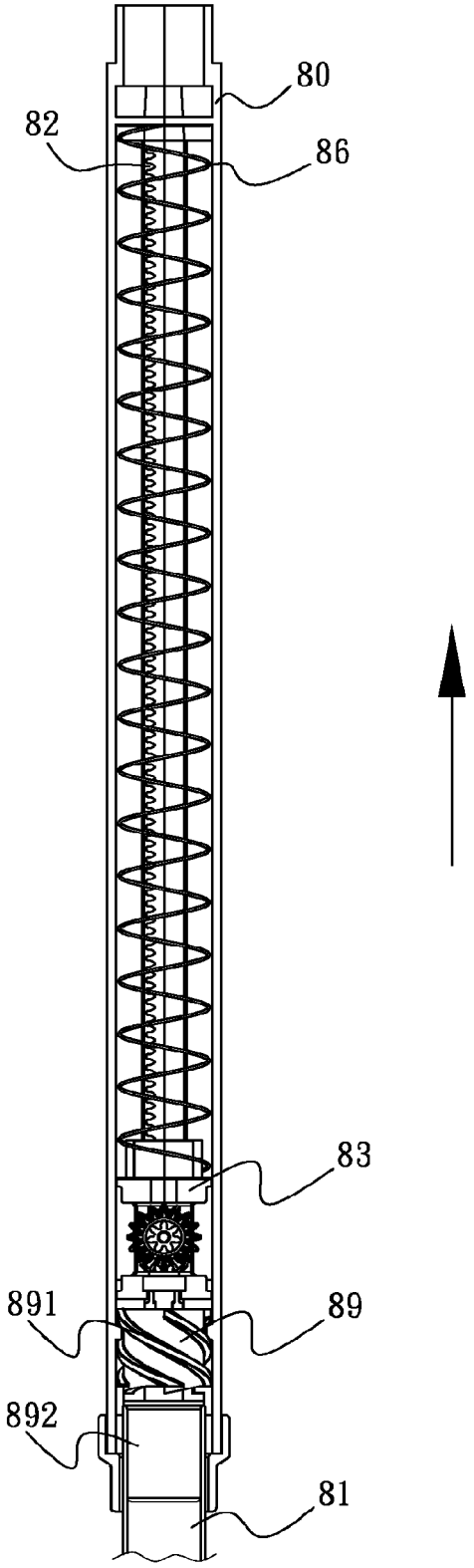
FIG. 24*b* is an illustration of the mop structure of the fifth embodiment of the invention being used.

Referring to FIGS. 24*a* and 24*b*, which are illustrations of operational directions of the rotational mop structure of the invention, the description of the structures of the fifth embodiment should be read in conjunction with these drawings, and the operational method of the fourth embodiment is the same as the description below. As clearly shown in FIG. 24*a*, when the first gear 831 of the driving gear set 83 is moved upward along the unit of teeth 82, the moving distance is the same as a distance A' which the spring 86 is being compressed. At this moment, the second gear 832 and the third gear 833 are driven to rotate simultaneously by the first gear 831, and the internal bar 81 and the mopping disc 84 will be driven to rotate to the left by the spiral unit 89 which is locked with the third gear 833. As shown in FIG. 24*b*, when the first gear 831 is moved downward along the unit of teeth 82 by the elasticity of the spring 86, the moving distance is the same as a distance A which the spring 86 is being released as shown in the drawing. Because of the dispositions of a first unilateral bearing 834 and a second unilateral bearing 835, when the first gear 831 is moved downward along the unit of teeth 82, the first gear 831 is motionless, and the second gear 832 and the third gear 833 are not driven to rotate, so that the internal bar 81 and the mopping disc 84 will not be rotated.

Because the second gear 832 of the driving gear set 83 is larger than the first gear 831 and the third gear 833, and based on the principle of variable pitches, when the driving gear set 83 is being rotated, the bigger gear (the second gear) is driven by the smaller gear (the first gear), and then the smaller gear is driven by the bigger gear, thereby, it is even more effort saving for the user during usage.

Figure 25:
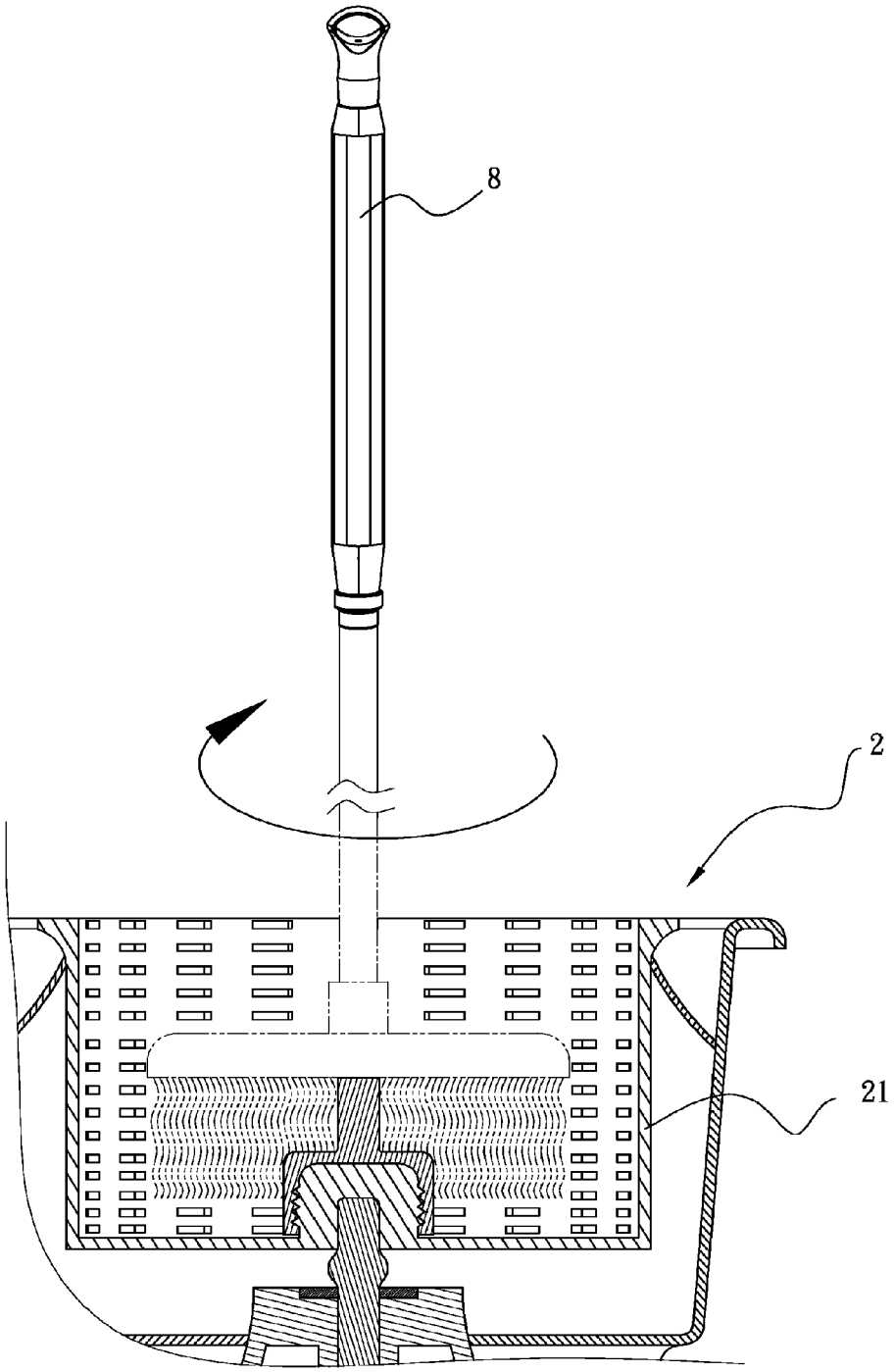
FIG. 25 is an illustration of the mop structure of an embodiment of the invention being dehydrated by spinning.

FIG. 25 is an illustration of the rotational mop structure of the invention being dehydrated by spinning in the mop supporting unit 21.

Note that the specifications relating to the above embodiments should be construed as exemplary rather than as limitative of the invention, with many variations and modifications being readily attainable by a person of average skill in the art without departing from the spirit or scope thereof as defined by the appended claims and their legal equivalents.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several benefits of the invention are achieved and other advantageous results attained.

As various changes could be made in the above system and method without departing from the scope of the invention, it is intended that all matter contained in the above description and shown in the accompanying drawings shall be interpreted as illustrative and not in a limiting sense.

What is claimed is:

1. A mop cleaning set comprising:

a dehydration device for dehydrating a mop structure, said dehydration device comprising:

a base having a through hole;

a mop supporting unit disposed above the base;

a bar fixing portion being disposed at the bottom of the mop supporting unit for supporting said mop structure; and a bar penetrated and secured in the bar fixing portion of the bottom of the mop supporting unit and the through hole of the base, said bar having a first protruded portion and a second protruded portion being disposed on the bar, the first protruded portion being disposed between a bottom surface of the mop supporting unit and a top surface of the base for supporting the mop supporting unit, the second protruded portion being disposed below the through hole of the base for fixing the bar in the through hole of the base;

the mop structure comprising:

a grip bar;

a fixing base having a first fixing base portion and a second fixing base portion, the first fixing base portion being connected to the grip bar, the fixing base being used for supporting and fixing a cleaning body; and a connecting portion being composed of a flexible material, said connecting portion connecting with the first fixing base portion and the second fixing base portion of the fixing base, said flexible material of the connecting portion at the second fixing base portion being responsive to an external force to fold in a first direction or a second direction.

2. The mop cleaning set of claim 1, said dehydration device further comprising:

a first metal ring sleeved on the bar and being disposed between the first protruded portion and the top surface of the base, the first metal ring being used for the first protruded portion to press against to prevent the first protruded portion from pressing on the top surface of the base directly; and a second metal ring sleeved on the bar and being disposed between the second protruded portion and a bottom of the through hole, the second metal ring being used for the second protruded portion to press against to prevent the second protruded portion from pressing on the bottom of the through hole of the base directly.

3. The mop cleaning set of claim 2, wherein the second protruded portion is formed by pressing and is secured on the second metal ring.

4. The mop cleaning set of claim 1, wherein the first protruded portion of the bar comprises an arc shaped structure.

5. The mop cleaning set of claim 1, wherein the base further comprises a suction disc connected to a bottom of the base through a fixing pole, said suction disc securing the base on any flat surfaces.

6. The mop cleaning set of claim 1, said dehydration device further comprising:

the mop fixing element disposed in the mop supporting unit and being locked or fitted on the bar fixing portion for fixing the mop; and a water blocking plate fitted on the mop supporting unit externally and being moved upward and downward on the mop supporting unit, said water blocking plate blocking water thrown out in response to dehydration of the mop being placed in the mop supporting unit.

7. The mop cleaning set of claim 6, wherein the mop fixing element comprises one of the following shapes: a cylindrical shape and a circular cap shape.

8. The mop cleaning set of claim 6, further comprising an included angle between the water blocking plate and an outside surface of the mop supporting unit, said angle being less than 90 degrees.

9. The mop cleaning set of claim 1, wherein the mop supporting unit includes a dehydration basket with a plurality of holes.

10. The mop cleaning set of claim 1, wherein said mop structure further comprising an adhesive unit disposed on bottoms of the first fixing base portion and the second fixing base portion for adhering the cleaning body thereto.

11. The mop cleaning set of claim 10, wherein the adhesive unit comprises a re-closable fastener.

12. The mop cleaning set of claim 1, wherein the connecting portion, the first fixing base portion and the second fixing base portion being formed as one piece.

13. The mop cleaning set of claim 1, wherein the second fixing base portion comprises a first plate and a second plate, the first plate and the second plate being connected to two ends of the first fixing base portion via the connecting portion.

14. The mop cleaning set of claim 13, wherein the fixing base portion comprises a U-shape in response to an external force exerted to fold the first plate and the second plate upwardly in the first direction.

15. The mop cleaning set of claim 13, wherein the fixing base portion comprises a U-shape in response to an external force exerted to fold the first plate and the second plate downwardly in the second direction.

16. The mop cleaning set of claim 1, further comprising a space being disposed above and below the connecting portion, said the space being formed by the connecting portion and for moving range of the second fixing base portion as folded in response to an external force exerted on the second fixing base portion.

17. The mop cleaning set of claim 1, wherein the first fixing base portion has a lateral side and the second fixing base portion has a lateral side, wherein the lateral side of the first fixing base portion and the lateral side of the second fixing base portion include inclined surfaces or arc-shaped surfaces.

18. The mop cleaning set of claim 1, further comprising a positioning unit being disposed at the center of a bottom surface of the first fixing base portion for positioning the fixing base on a water bucket with dehydration function for securing the fixing base on the water bucket with dehydration function by the positioning unit during dehydration.

19. The mop cleaning set of claim 1, wherein said mop structure further comprising a pivotal unit pivotally connected to the grip bar and the fixing base, wherein the fixing base rotates about the grip bar in different angles through the pivotal unit.

20. The mop cleaning set of claim 1, wherein the cleaning body comprises one of the following materials: a cloth, a sponge, and a cleaning paper.

* * * * *